US007784231B2

(12) United States Patent
Termohlen

(10) Patent No.: US 7,784,231 B2
(45) Date of Patent: Aug. 31, 2010

(54) MULTI-STORY BUILDING

(75) Inventor: David E. Termohlen, Las Vegas, NV (US)

(73) Assignee: Thornton-Thermohlen Group Corporation, Las Vegas, NV (US)

( * ) Notice: Subject to any disclaimer, the term of this patent is extended or adjusted under 35 U.S.C. 154(b) by 346 days.

(21) Appl. No.: 11/746,834

(22) Filed: May 10, 2007

(65) Prior Publication Data

US 2008/0276550 A1 Nov. 13, 2008

(51) Int. Cl.
*E04H 1/02* (2006.01)

(52) U.S. Cl. ..... 52/236.5; 52/79.14; 52/263; 52/741.14; 52/745.2

(58) Field of Classification Search ..... 52/79.14, 52/236.5, 741.14, 745.2, 249, 263, 264, 272, 52/280

See application file for complete search history.

(56) References Cited

U.S. PATENT DOCUMENTS 2,618,146 A * 11/1952 Ciarlini ..... 52/252
3,295,266 A * 1/1967 Van Bijlevelt ..... 52/83
3,342,008 A * 9/1967 Frey ..... 52/745.04
3,396,502 A 8/1968 Contevita
3,686,816 A 8/1972 Erbil
3,729,878 A 5/1973 Termohlen et al.
3,732,655 A 5/1973 Termohlen et al.
3,822,522 A 7/1974 Termohlen et al.
3,895,473 A 7/1975 Fraser
3,981,109 A * 9/1976 Termohlen ..... 52/125.1
4,071,988 A * 2/1978 Bowes ..... 52/127.1
4,667,923 A 5/1987 Lee
5,678,373 A 10/1997 Franklin et al.
5,839,243 A 11/1998 Martin
6,575,665 B2 * 6/2003 Richter et al. ..... 405/195.1
2003/0033772 A1 2/2003 Russell
2004/0037653 A1 2/2004 Kelso

OTHER PUBLICATIONS

Bethlehem Steel Corporation Building Case History #25: Holiday Inn, Huntington, West Virginia Dec. 1972 http://www.aisc.org/content.aspx?id=2864.*

USPTO International Search Report and Written Opinion, Sep. 18, 2008, pp. 1-11, PCT/US08/62889.

* cited by examiner

*Primary Examiner*—Brian E Glessner
*Assistant Examiner*—Patrick Maestri
(74) *Attorney, Agent, or Firm*—Townsend and Townsend and Crew LLP

(57) ABSTRACT

According to the invention, a method for constructing a multi-story building is disclosed. The method may include slip forming a building core with support member casings deposited within the building core. The method may include providing support pedestals around the building core to support roof structural members, coupling roof structural members, and lifting the roof structure to a first elevation from a top of the building core. The method may include supporting support members with the support member casings, and supporting the roof structure at the first elevation with the support members. The method may include coupling a plurality of floor structural members on the support pedestals. The method may include lifting the floor structure to a second elevation from the top of the building core. The method may include supporting the floor structure at the second elevation with other support members.

19 Claims, 20 Drawing Sheets

MULTI-STORY BUILDING

BACKGROUND OF THE INVENTION

This invention relates generally to building construction. More specifically the invention relates to high rise building construction without intensive use of cranes.

Typical methods of building structures, especially high rise structures, involves building from the bottom-up. In bottom-up building, the first floors of a structure are the first floors constructed, and successive floors are added on top of the structure until it reaches its full height. This typically involves lifting, usually with cranes, structural and architectural materials to greater and greater heights as the desired building height increases.

Cranes, both low level and tower height, can be in short supply, and expensive to operate even when available. Additionally, there are increased labor and insurance costs with assembling floors at ever increasing heights. Furthermore, multi-level construction, both structural and architectural, often must occur exposed to the elements and environment using these building methods. Embodiments of the present invention provide solutions to these and other problems.

BRIEF DESCRIPTION OF THE INVENTION

In one embodiment, a method for constructing a multi-story building is provided. The method may include slip forming, vertically, at least one building core with a hardenable substance, where during slip forming, a plurality of support member casings may be deposited at least partially within the hardenable substance at a perimeter of the slip form. The method may also include providing a plurality of support pedestals around the base of each building core. The method may further include supporting a plurality of roof structural members with the support pedestals. The method may also include coupling at least one of the plurality of roof structural members with at least one other of the plurality of roof structural members to create a roof structure. The method may further include lifting the roof structure to a first elevation from a top of the at least one building core. The method may also include supporting a first plurality of support members at least partially with at least two of the plurality of support member casings. The method may further include supporting the roof structure at the first elevation with the first plurality of support members. The method may also include supporting a plurality of floor structural members with the support pedestals. The method may further include coupling at least one of the plurality of floor structural members with at least one other of the plurality of floor support members to create a floor structure. The method may also include lifting the floor structure to a second elevation from the top of the at least one building core, where the second elevation may be lower than the first elevation. The method may further include supporting a second plurality of support members at least partially with at least two of the plurality of support member casings. The method may also include supporting the floor structure at the second elevation with the second plurality of support members.

In another embodiment, a multi-story building is provided. The multi-story building may include at least one building core, where the at least one building core may be vertically slip formed from a hardenable substance. A plurality of support member casings may be deposited at least partially within the hardenable substance at a perimeter of the at least one building core. The multi-story building may also include a roof structure. The roof structure may include a plurality of roof structural members, and at least one of the plurality of roof structural members may be coupled with at least one other of the plurality of roof structural members. The roof structure may be located at a first elevation after being lifted from a top of at least one building core, and may be at least partially supported at the first elevation by a first plurality of support members at least partially supported by at least two of the plurality of support member casings. The multi-story building may further include a floor structure. The floor structure may include a plurality of floor structural members, and at least one of the plurality of floor structural members may be coupled with at least one other of the plurality of floor structural members. The floor structure may be located at a second elevation after being lifted from a top of at least one building core, where the second elevation may be lower than the first elevation. The floor structure may be at least partially supported at the second elevation by a second plurality of support members at least partially supported by at least two of the plurality of support member casings.

BRIEF DESCRIPTION OF THE DRAWINGS

The present invention is described in conjunction with the appended figures.

Figure 1:
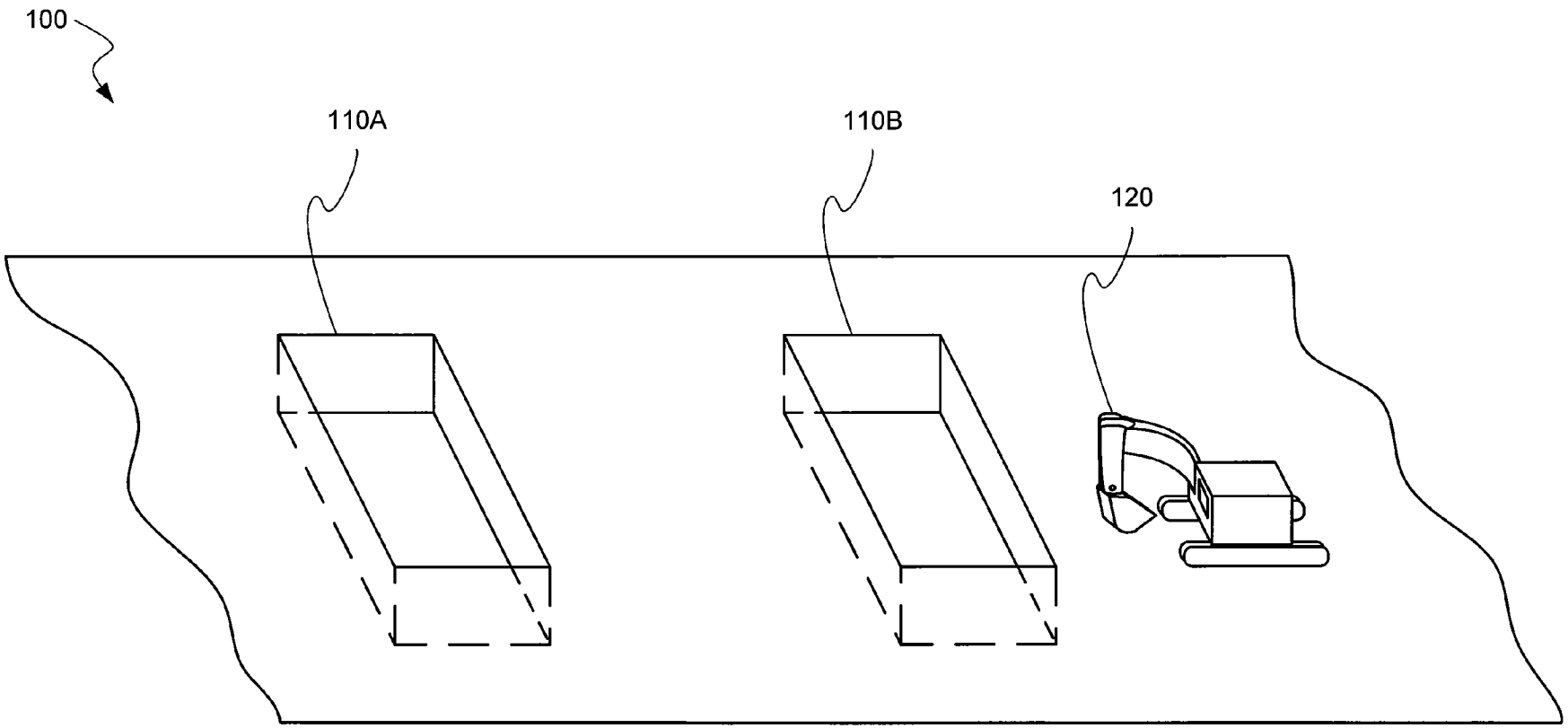
FIG. 1 is an axonometric view of a building job site, with the upper foundation area excavated.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, systems, structures, and other components may be shown as components in block diagram form in order not to obscure the embodiments in unnecessary detail. In other instances, well-known processes, procedures and techniques may be shown without unnecessary detail in order to avoid obscuring the embodiments.

Also, it is noted that individual embodiments may be described as a process which is depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process may be terminated when its operations are completed, but could have additional steps not included in a figure. A process may correspond to a method, a process, a procedure, a technique, etc. Furthermore, embodiments may be implemented by manual techniques, automatic techniques, or any combination thereof.

In one embodiment of the invention, a method for constructing a multi-story building is provided. In some embodiments, one or more foundations may first be provided to transfer building loads, both static and dynamic to the ground. The foundation may be shallow or deep. Merely by way of example, shallow foundations may include a spread footing or slab-on-grade foundation. Also by way of example, deep foundations may include pre-fabricated pile foundation systems, drilled piers, cast-in-drilled-hole piles, underreamed piles, and auger cast piles.

The method may then include slip forming, vertically, at least one building core with a hardenable substance. In some embodiments, the hardenable substance may be concrete. Merely by way of example, regular concrete, high-strength concrete, high-performance concrete, and self-compacting concrete. In some embodiments, slip forms may be provided which slip vertically by pressing off the building core which they are forming. In some embodiments, extendable elements, for example, telescoping hydraulic jacks, may be used to push the slip form upward off the ground, as well as away from fixed points on the building core during formation. The rate at which the slip form moves upward may be dependent on a number of factors including the curing time. In some embodiments, the slip forms may move upward at a rate of 16 inches per hour until the final height of the building core is reached.

In some embodiments, where there will be a plurality of building cores formed, each slip form may be coupled with one or more other slip forms. This may at least assist the slip forms in remaining on the same plane as each other. In embodiments where a large number of stories are to be provided (or even in embodiments with fewer stories), coupling the slip forms with each other may at least assist in ensuring that the formed building cores are parallel to each other. In some embodiments, lightweight trusses may be used to couple any one slip form to another. In some embodiments, cabling may also be used to provide diagonal bracing. Turnbuckles or similar components may provide for fine tuning of the distance between and angular orientation of slip forms. Additionally, in some embodiments, one or more walkways may be coupled with the coupling component(s) to allow workers to move between coupled slip forms.

In some embodiments then, extending elements will initially push the slip form away from the ground. After the slip form is a certain distance from the ground, the extending elements may push the slip form away from fixed points on the walls of the formed building core. Fixed points may be provided by inserting temporarily filled hollow members into the top of the slip form while the hardenable substance is inserted into the slip form. Once the slip form has risen above these temporarily filled hollow members, the filling may be removed, and a support member may be inserted into the resulting cavity. The extending element may then push the slip form upwards off of the support member, thereby using the wall of the recently formed building core to support the movement of the slip form.

A sensing and control mechanism may be used to ensure each extending element moves upward at the proper rate. In some embodiments, multiple lasers may be coupled with the slip form at various locations and measure the distance to the ground. Individual extending elements may then be controlled, possibly by an automated system, to ensure that each jack works with all other jacks to ensure the slip form stays level and the building core is formed at least substantially vertically. In other embodiments, a single laser, possibly located in the interior of the slip form may inform an automated system of the orientation of the slip form and thereby control the extending elements.

Any slip form used in the invention may have one or more working levels. Merely by way of example, a lower work level may be provided on the slip form to allow workers to adjust the extendable elements. For example, workers or an automated means may move the support elements to new, higher cavities to continue upward movement via supporting the extending elements at the higher supporting elements.

An upper work level may also be provided on the slip form in some embodiments. The upper work level may allow workers to insert reinforcing members (for example, rebar and/or wire mats) into the hardenable substance as it is inserted into the slip form. Reinforcing members inserted into the slip forms may initially be coupled with reinforcing members protruding from the foundation.

The upper and/or lower work level may include a number of devices to facilitate the operations of the slip form. Merely by way of example, the work levels may include jibs to lift work materials and supplies (for example, those described above) to the working levels of the slip form from the ground below.

During slip forming, a plurality of support member casings may also be deposited at least partially within the hardenable substance, possibly at a perimeter of the slip form (i.e. the perimeter of the building core). These support member casings may be inserted into the hardenable substance from an upper working area. The support member casings may have a temporarily filled void, similar to the hollow members described above. In some embodiments, the support member casing may have a vertical element coupled to, or coupleable with it such that the vertical member assists in determining the distance between floors and other floors and/or the roof.

In some embodiments then, a vertical member may be inserted into the slip form to identify a vertical distance to the first set of support member casings at a first elevation, which will be used to assist in supporting the second floor of the building (with the first floor being at ground level). Additional vertical members may then be coupled with the top of the support member casings to identify the vertical height to the next set (which will be used to assist in supporting the third floor and upward of the building). Any coupling of vertical members and/or support member casings may be done prior to encasement of the immediate coupling surfaces in hardenable substance within the slip form.

As the building core or cores are formed, equipment may be installed within the building core, including, but not limited to, man-lifts to assist in transporting workers between the ground and the slip form, elevator equipment such as rails, temporary and/or permanent stairs, mechanical (heating, ventilation, and air conditioning ("HVAC")) equipment, plumbing equipment, and/or electrical equipment.

Furthermore, in some embodiments, in addition to the hollow members and support member casings, additional inserts may also be deposited within the hardenable substance as the slip form creates the building core. These inserts may be deposited at the proper locations per architectural and engineering plans provided beforehand. Merely by way of example, collapsible and re-usable door bucks (to define where doors will later be installed at the building core), support mounting equipment (for example, plates on the interior walls by which flooring may be coupled at various levels), other inserts which will allow future installed mechanical, plumbing and electrical equipment to penetrate the building core walls.

The method may also include providing a plurality of support pedestals around the base of each building cores so that a plurality of roof structural members may be supported with the support pedestals. The support pedestals may vary in size and shape to support different sizes and numbers of structural members. For example, in some embodiments, the support pedestals may be different height to support different height structural members.

In some embodiments, one or more of the support pedestals may include a vertical protrusion on the top portion. Support members to be support by those pedestals having the vertical protrusion may have a cavity defined on the bottom portion of the structural members which will at least partially mate with the vertical protrusion. In this manner, structural members may be precisely aligned in relation to other structural members, when the support pedestals are properly located. In some embodiments, a portion of the upper exposed surfaces of the support pedestals may have tapered surfaces to more easily allow structural members to be properly located on the top of the support pedestals.

The method may also include coupling at least one of the plurality of roof structural members with at least one other of the plurality of roof structural members to create a roof structure. In some embodiments, one or more of the plurality of structural members may define at least one cavity through themselves. Another structural member or members may then be passed through these cavities and coupled together by a variety of methods such as welding and or mechanical fastening. In these or other embodiments, some shorter roof structural members may be employed and coupled without cavities and pass-through type couplings.

Any number of different types and sizes of structural members may be used for the roof structural members dependent on many factors. While in some embodiments, I-beams may be employed, in other embodiments, Z-shape beams, hollow structural section beams, angle beams, T-beams, channels, rail profile beams, etc. may also be used. Some of the factors affecting which types of structural members are used may include different static and dynamic loads, structural and use loads, as well as different desired shaped building perimeters at the roof line.

Decking, such as metal sheeting may then be coupled with at least some portion of the roof structural members. A hardenable substance, for example concrete, may then be poured on top of the roof structural members to complete the roof structure. In some embodiments, other materials may be used to finish the roof structure. Merely by way of example, composite materials may be coupled with the roof structural members to complete the roof structure for lightweight roof constructions.

When possible, building roof top equipment such as elevator machinery, HVAC equipment, as well as plumbing and electrical equipment may be loaded onto the finished roof structure. Additionally, parapet finishing materials may be loaded onto the roof structure for later assembly and/or construction.

The method may further include lifting the roof structure to a first elevation from a top of the at least one building core. The first elevation may be in proximity to the top of the building core or building cores. In some embodiments this may be accomplished by coupling one or more strand jacks with the top of the building core or building cores. The strands from the strand jack may then be coupled with the roof structure, and the strand jack(s) activated to lift the roof structure. When more than one strand jack is employed, automatic or manual systems may assist in ensuring the roof structure is lifted in a level manner. Reinforcement members may be coupled with either one of, or both, the building core(s) and the roof structure to evenly spread the weight load, thereby reducing the force per square inch of the roof structure to the lifting mount (the building core(s)), and the lifted weight (the roof structure).

In some embodiments, construction/assembly of any rooftop components and machinery may begin before the rooftop structure is lifted. Construction/assembly may also occur during and after lifting. By loading construction materials and supplies onto the roof structure before lifting, the need for a crane to lift such materials and supplies to the roof after it is in its elevated position is obviated.

As the roof structure is lifted, workers on the roof structure may remove the temporary filling from the support member casings. Furthermore, any other inserts in the building core may also be removed as the roof structure is lifted. Any other finishing of the building core(s) may also be accomplished as the roof structure is lifted.

The method may also include supporting a first plurality of support members at least partially with at least two of the plurality of support member casings. The method may further include supporting the roof structure at the first elevation with the first plurality of support members. Once the roof structure has reached the first elevation, support members may be inserted in the support member casings. Therefore, in some embodiments, the support member casings may have openings in a variety of fashions to allow a support member to be inserted and supported by the support member casing, and consequently the building core structure.

In some embodiments, one or more support members may be supported by the support member casings such a first end of the first support member protrudes from a first side of the first building core, and a second end of the first support member protrudes from a second side of the second building core, each side being around a central area of the support member. In other words, the support member may be supported diagonally in respect to the walls of the rectangular or square building core. In some embodiments, the support member may protrude further from one portion of the support member casing than it protrudes from another portion of the support member casing.

In some embodiments, the support member may be slideably coupled with the underside of the roof structure prior to being raised from the support pedestals (or shortly thereafter). A pull cord or other means may allow the support member to be slid into position in the support member casing from above the roof structure, at least reducing the need the workers to operate beneath the roof structure. Such support movement mechanisms can be installed during assembly of the roof structure or anytime thereafter. In some embodiments, the mechanism can be wielded to a chassis which may be coupled with the roof structure prior to pouring of the hardenable substance to finish the roof structure.

The method may further include conducting the same or similar steps to those described above to construct a floor structure on the support pedestals, lift to the proper elevation, and support using support members. Additionally, after a floor structure has been constructed on the support pedestals, a curtain wall may also be constructed around the perimeter of the floor. The curtain wall may be constructed while the floor structure is still supported by the pedestals, while the floor structure is being lifted into final position, or some combination thereof. The curtain wall constructed on the first floor structure created will provide the exterior wall between the roof and the first floor structure (the top floor of the building).

In some embodiments, some portion of architectural instructions may be printed or otherwise displayed on the completed floor structure. This may assist workers in completing interior architectural features such as walls, as well as mechanical, electrical and plumbing systems. In some embodiments, the architectural instructions may be printed onto a resilient paper or other material and then coupled with the top of the floor structure. Resilient materials will allow workers to walk on the materials without destroying or making the architectural instructions illegible or unintelligible. Before the floor structure is lifted from the support pedestals, or shortly thereafter, construction materials and supplies may be loaded onto the floor structure, obviating the need for a crane to lift such materials and supplies to the floor after it is in its final elevated position.

When all floor structures are in place, a final curtain wall may be constructed between the bottom of the second floor of the building and the ground (or first) floor. Note that any shape floor may be constructed using the method described herein. Additionally, not all floors must be of the same shape and size. Finally, some sections of each floor may be exposed to the environment (outside the curtain wall), either creating balcony type areas or courtyard type semi-enclosures.

Figure 2:
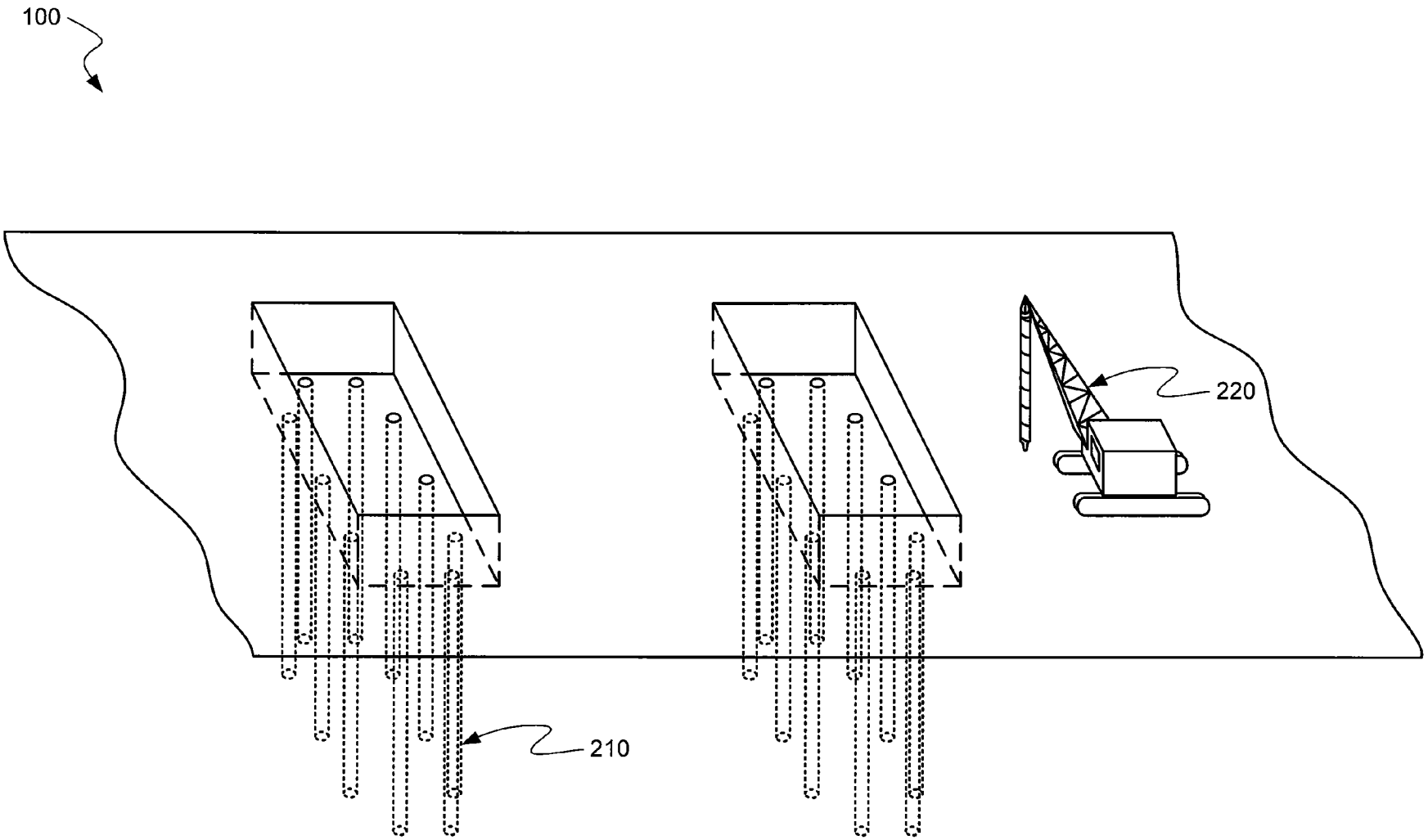
FIG. 2 is axonometric view of the job site shown in FIG. 1, with excavated caisson cavities.

Turning now to FIG. 1, an axonometric view of a building job site 100 with the upper foundation areas excavated 110 is shown. In this example, a back hoe 120 is shown being used to excavate upper foundation areas 110. In this embodiment, the building will have two building cores, one at each upper foundation area 110. FIG. 2 is axonometric view of the job site 100 shown in FIG. 1, with excavated caisson cavities 210. In this example, a mobile construction drill auger 220 is shown being used to excavate caisson cavities 210.

Figure 3:
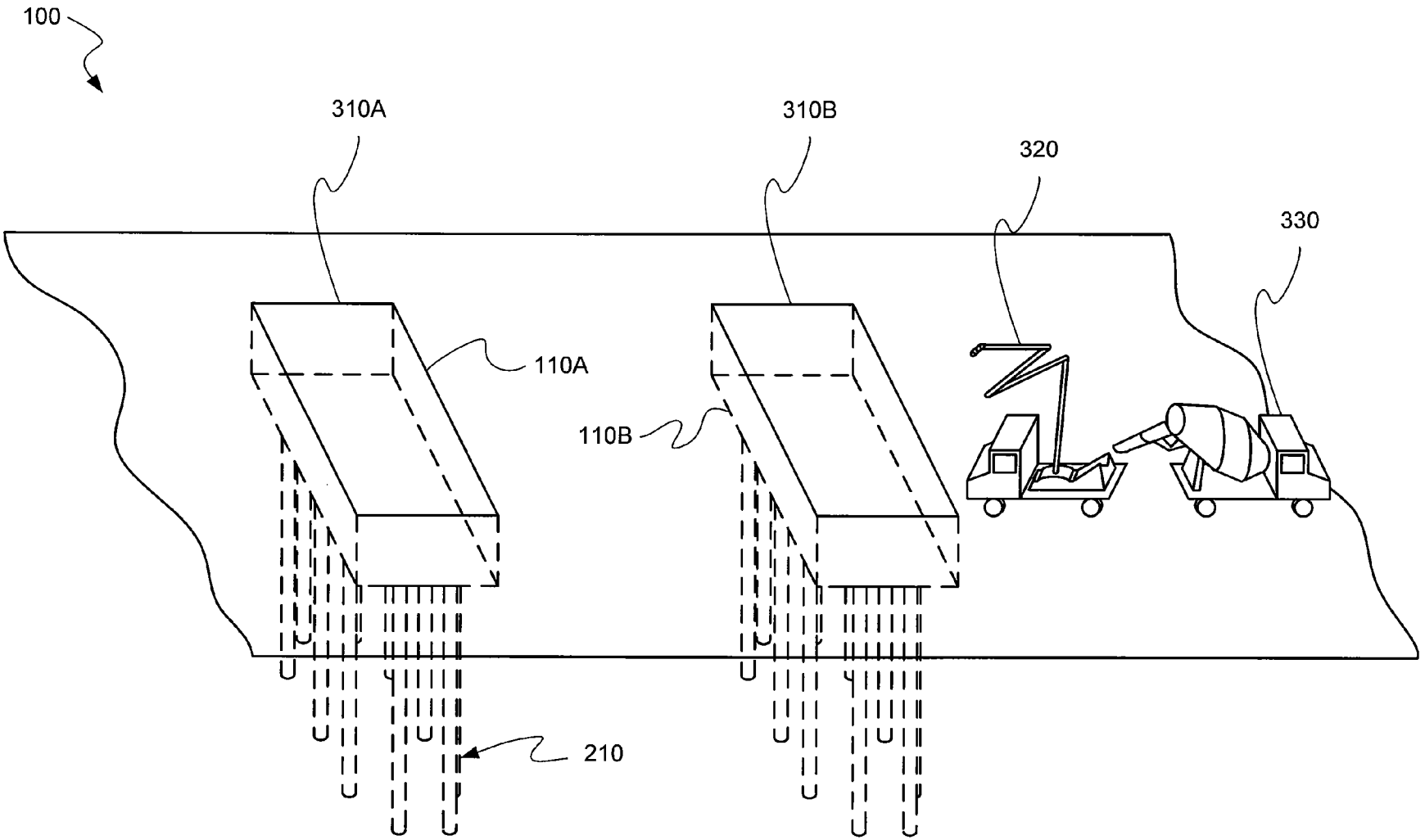
FIG. 3 is axonometric view of the job site shown in FIG. 2, with concrete poured foundations.

FIG. 3 is axonometric view of the job site 100 shown in FIG. 2, with concrete poured foundations 310B. In this example, concrete may first be poured into caisson cavities 210 after reinforcement materials such as rebar are positioned therein. The reinforcement materials may protrude from the top of caisson cavities 210 and integrate with concrete (and reinforcement materials) poured into excavated upper foundation areas 110. Concrete may be poured into caisson cavities 210 with a concrete pump 320 and concrete truck 330.

Figure 4:
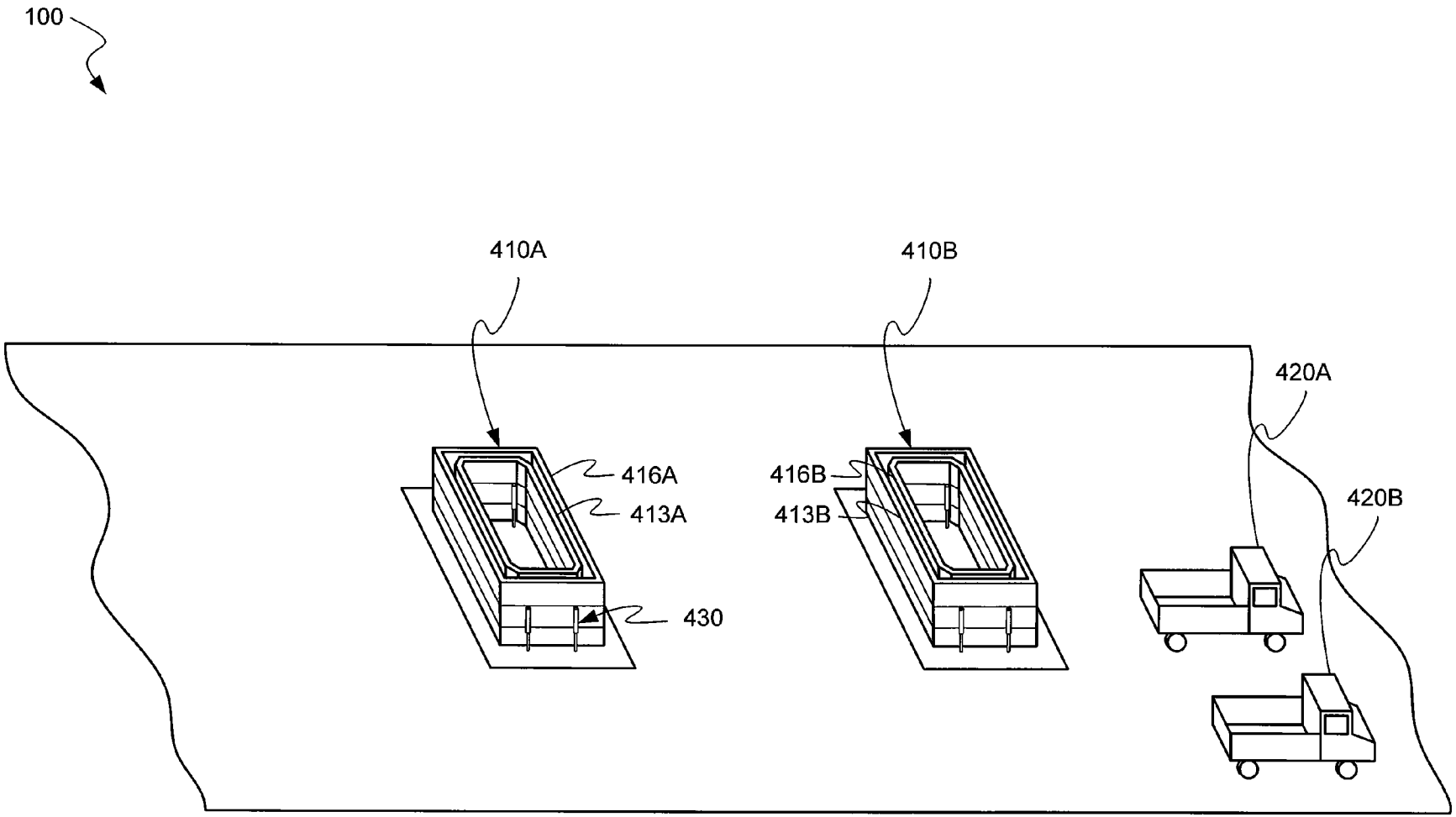
FIG. 4 is axonometric view of the job site shown in FIG. 3, with assembled slip forms.

FIG. 4 is axonometric view of the job site 100 shown in FIG. 3, with assembled slip forms 410. Slip forms 410 may be assembled on job site 100 after being delivered via supply vehicles 420. Slip forms 410 may be modular and assembled from available components to create slip forms 410 for the proper number, shape and size building cores to be constructed. Though FIG. 4 shows rectangular slip forms 410, any other shape may also be provided.

For purposes of clarity, joint members coupling the inner form shell 413 to the outer form shell 416 on each slip form 410 are not shown. These joint members may assist or ensure that the inner form shell 413 remains stationary relative to the outer form shell 416, and hence the wall thickness of the resultant building core remains consistent. Each slip form 410 also includes extendable elements 430 to move slip forms 410 upward.

Figure 5:
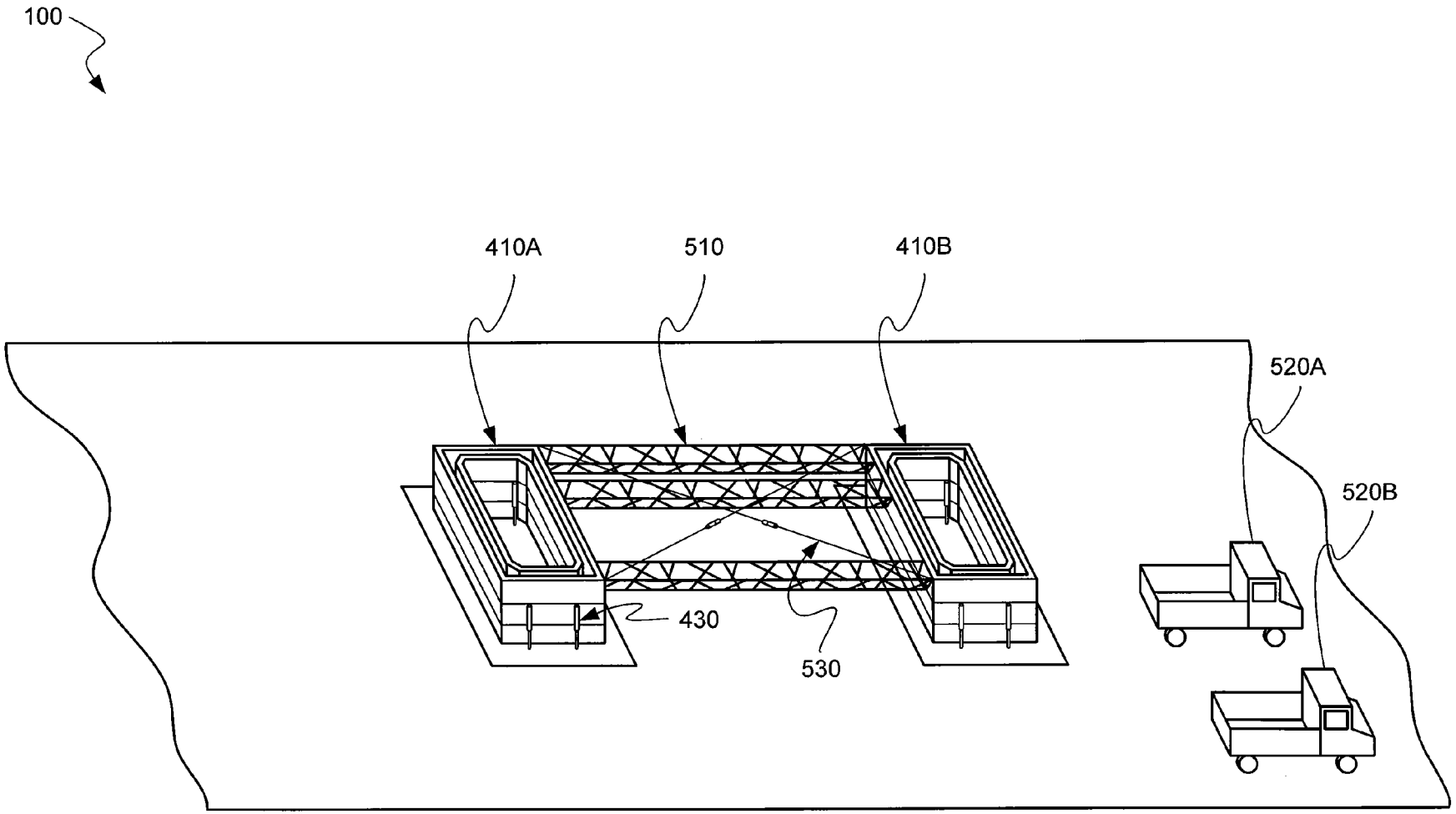
FIG. 5 is axonometric view of the job site shown in FIG. 4, with trusses spanned between the slip forms.

FIG. 5 is axonometric view of the job site 100 shown in FIG. 4, with trusses 510 spanned between the slip forms. Supply vehicles 520 may deliver trusses 510 to job site 100. Trusses 510, or any other possible type of members, may assist or ensure that building cores formed by slip forms 410 are parallel to each other. Additionally, effects of alignment systems used on one slip form 410 to ensure true vertical climb will be transferred to other slip forms 410, possibly obviating the need for a separate alignment system on each slip form 410. Tensioned cables with turnbuckles 530 may also be employed as shown in FIG. 5 or otherwise. Note that while two slip forms 410 are shown in this embodiment, in other embodiments, any number of slip forms 410 may be provided to make more or less than two building cores. In these embodiments, trusses 510, or any other possible type of members (and cables 530), may be employed between any combination of the total number of slip forms 410.

Figure 6:
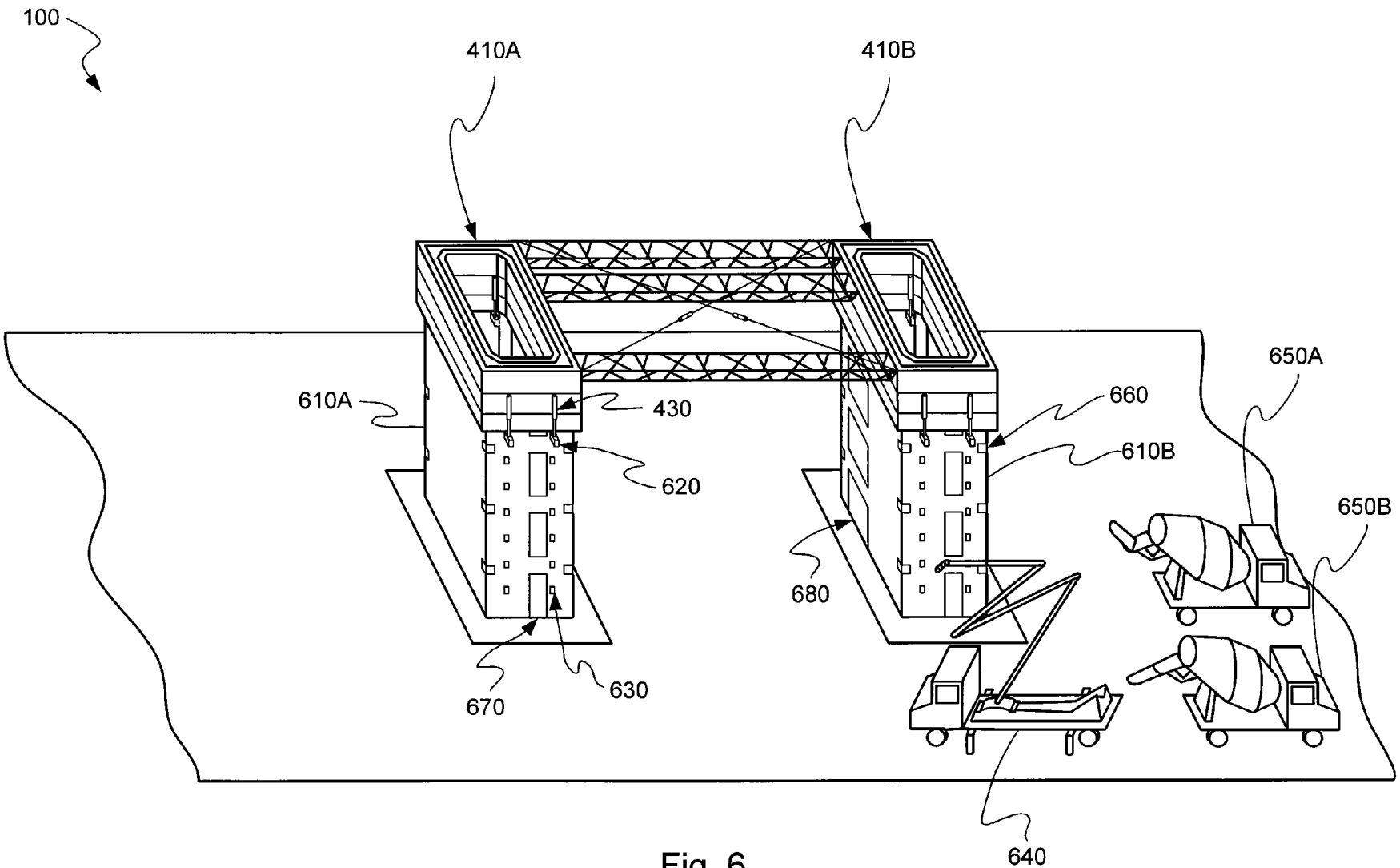
FIG. 6 is axonometric view of the job site shown in FIG. 5, during slip forming operations of the building cores.

FIG. 6 is axonometric view of the job site 100 shown in FIG. 5, during slip forming operations of the building cores 610. After initially lifting slip forms 410 off of the ground/foundations with extendable elements 430, further lifting of slip forms 410 may be accomplished by pushing off temporary slip form support member 620 which may be temporarily inserted into hollow cavities 630.

Hollow cavities 630 may be created as described above by inserting a hollow member into the slip form during pouring of the hardenable substance into slip forms 410. A temporary substance may be inserted in the hollow members to prevent hardenable substance from filling in the hollow members. Removal of the temporary substance will allow hollow cavities 630 to be used to support temporary slip form support members 620. As slip forms 410 move higher, higher hollow cavities 430 may be used to support temporary slip form support members 620 at higher levels. In some embodiments, high pressure concrete pumps 640 may be used to deliver concrete from concrete supply sources 650 to slip forms 410 as they climb in elevation.

Additionally, during slip forming, support member casings 660 may be inserted into the hardenable substance. Support member casings may be filled with a temporary substance at least for similar reasons as described above in relation to the hollow members. As also discussed above, support member casings 660 will be used later in the process to support support members which will support a roof structure and floor structures. Also inserted into the slip forms 410 during slip forming may be removable door bucks 670 and elevator door bucks 680. Vertical members 661 may be coupled to or coupleable with support member casings 660, for example to assist in determining the distance between floors and other floors.

Figure 7:
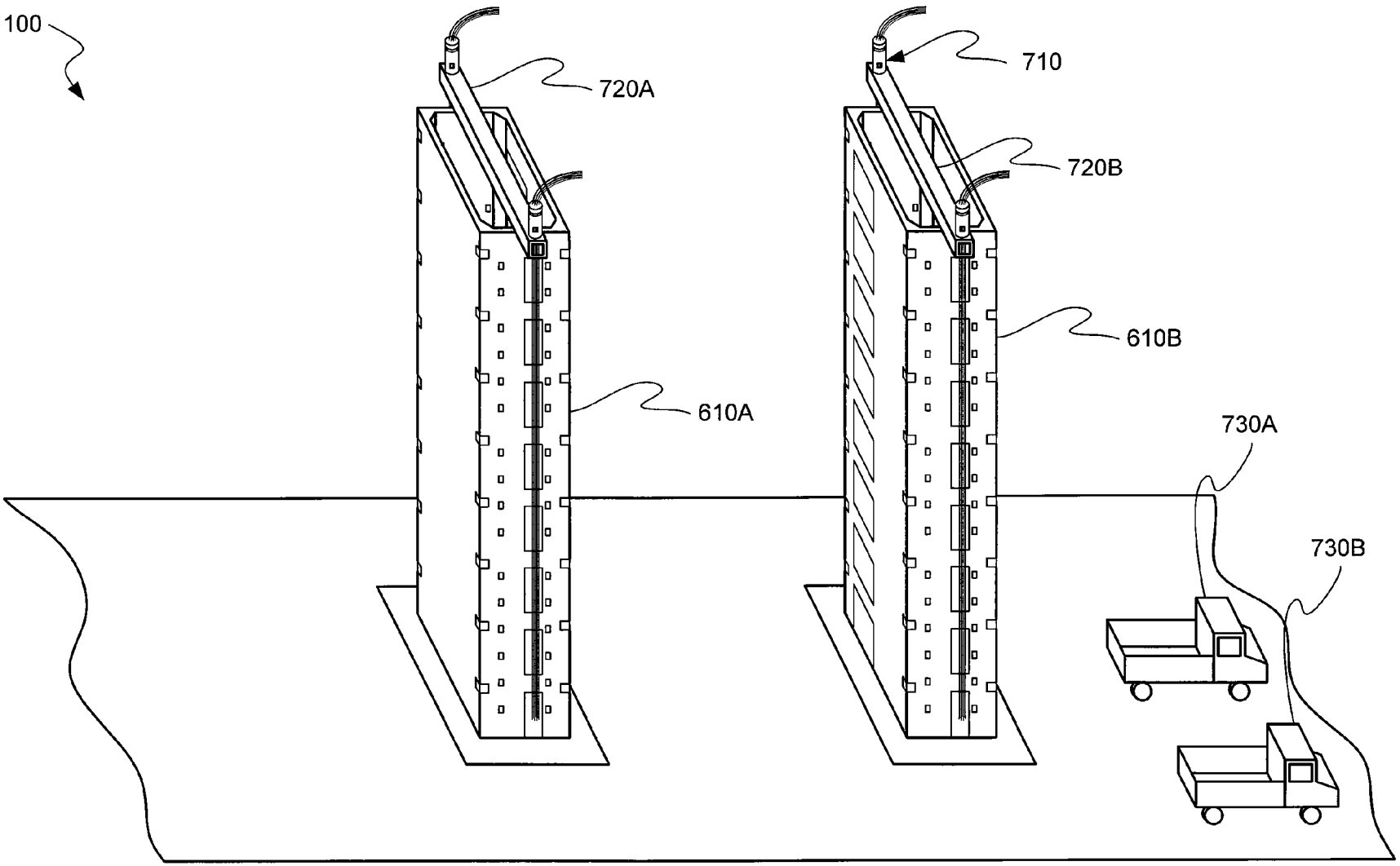
FIG. 7 is axonometric view of the job site shown in FIG. 6, with strand jacks installed on each building core.

FIG. 7 is axonometric view of the job site 100 shown in FIG. 6, with strand jacks 710 installed on each building core 610. After completion of building cores 610, jibs on slip forms 410 (then at the top of building cores 610) may be used to lift strand jacks 710 to the top of building cores 610. A structural and/or reinforcement member 720 may at least assist in spreading future dynamic loading of strand jacks 710 throughout building cores 610, utilizing more of the full strength of building cores 610. After providing the lifting device (in this embodiment, strand jacks 710) to the top of building cores 610, slip forms 410 may be lowered to the ground and removed from job site 100. Supply vehicles 730 may deliver strand jacks 710 and reinforcement members 720 to job site 100.

Figure 8:
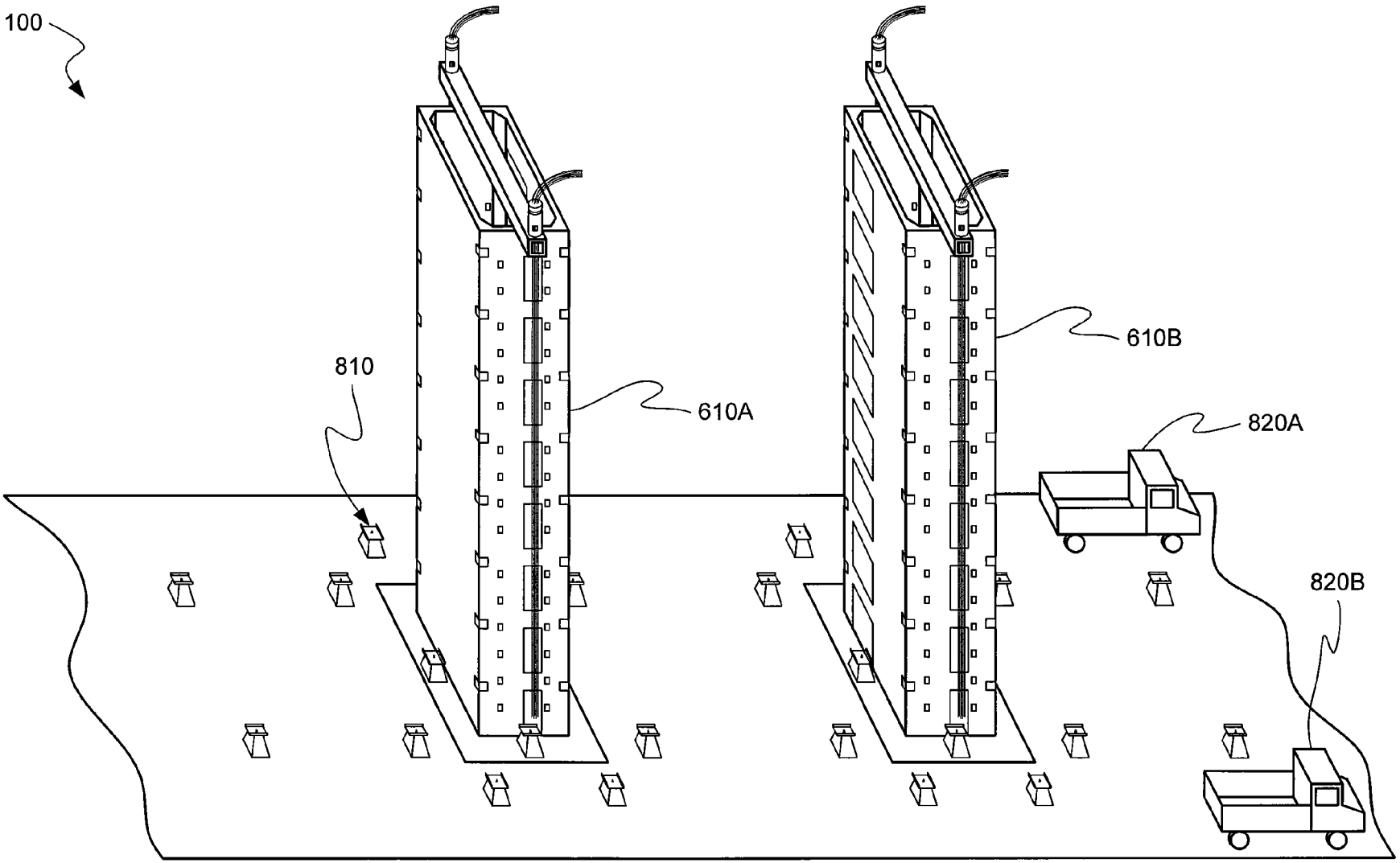
FIG. 8 is axonometric view of the job site shown in FIG. 7, with structural member support pedestals placed about the building cores.

FIG. 8 is axonometric view of the job site 100 shown in FIG. 7, with structural member support pedestals 810 placed about the building cores 610. Transport vehicles 810 may bring support pedestals 810 to job site 100, and workers, possibly with the assistance of surveyors, may accurately locate the support pedestals around building cores 610. The locations of support pedestals 810 will reflect the layout of structural members which will at least partially make up the roof structure and subsequent floors. Though a certain number of support pedestals 810 are shown in FIG. 8, the specific number of support pedestals 810 may depend on the number and size/length of the structural members to be used in the specific building construction.

Figure 9:
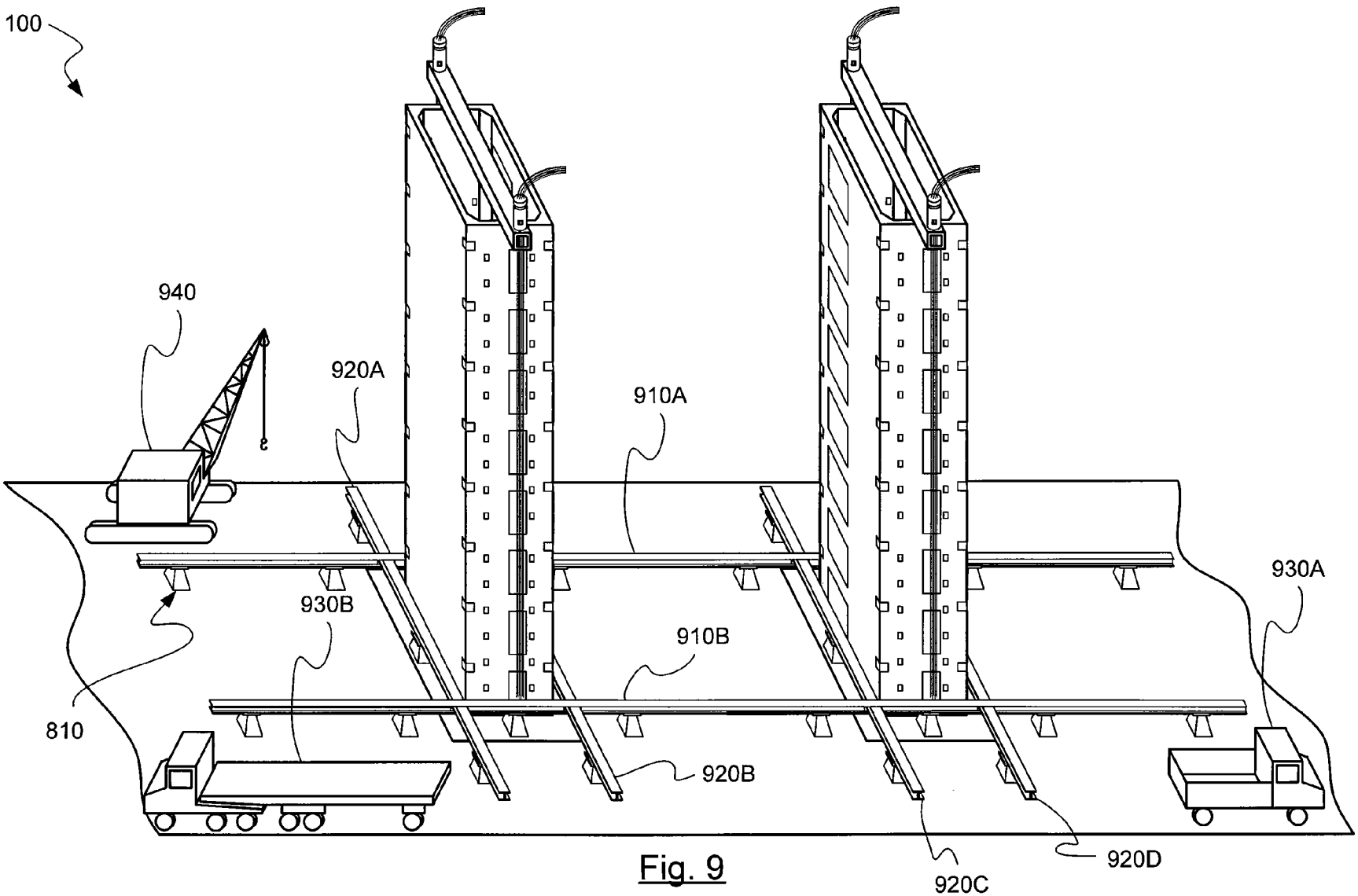
FIG. 9 is axonometric view of the job site shown in FIG. 8, with roof structural members coupled and placed on the support pedestals.

FIG. 9 is axonometric view of the job site 100 shown in FIG. 8, with roof structural members 910, 920 coupled and placed on the support pedestals 810. Roof structural members may include longitudinal roof structural members 910 and lateral roof structural members 920. The roof structural members 910, 920 shown are merely representative. In many embodiments, many more roof structural member 910, 920 may be used. While in some embodiments, smaller longitudinal roof structural members 910 and lateral roof structural members 920 may be coupled using mechanical fasteners and other techniques such as welding, in some embodiments, for example the one shown in FIG. 9, longer longitudinal roof structural members 910 and lateral roof structural members 920 may be used, and cavities in whole members may allow other whole members to pass through and be coupled, resulting in increased structural strength. Furthermore, additional, possibly smaller, structural members may outline the perimeter of the completed roof structure. These additional structural members may at least assist in supporting or stabilizing curtain walls by coupling the curtain walls with the roof structure (or floor structures which will be discussed below). Supply vehicles 930 and mobile jibs 940 may assist in providing and placing structural members 910, 920 at job site 100.

Figure 9A:
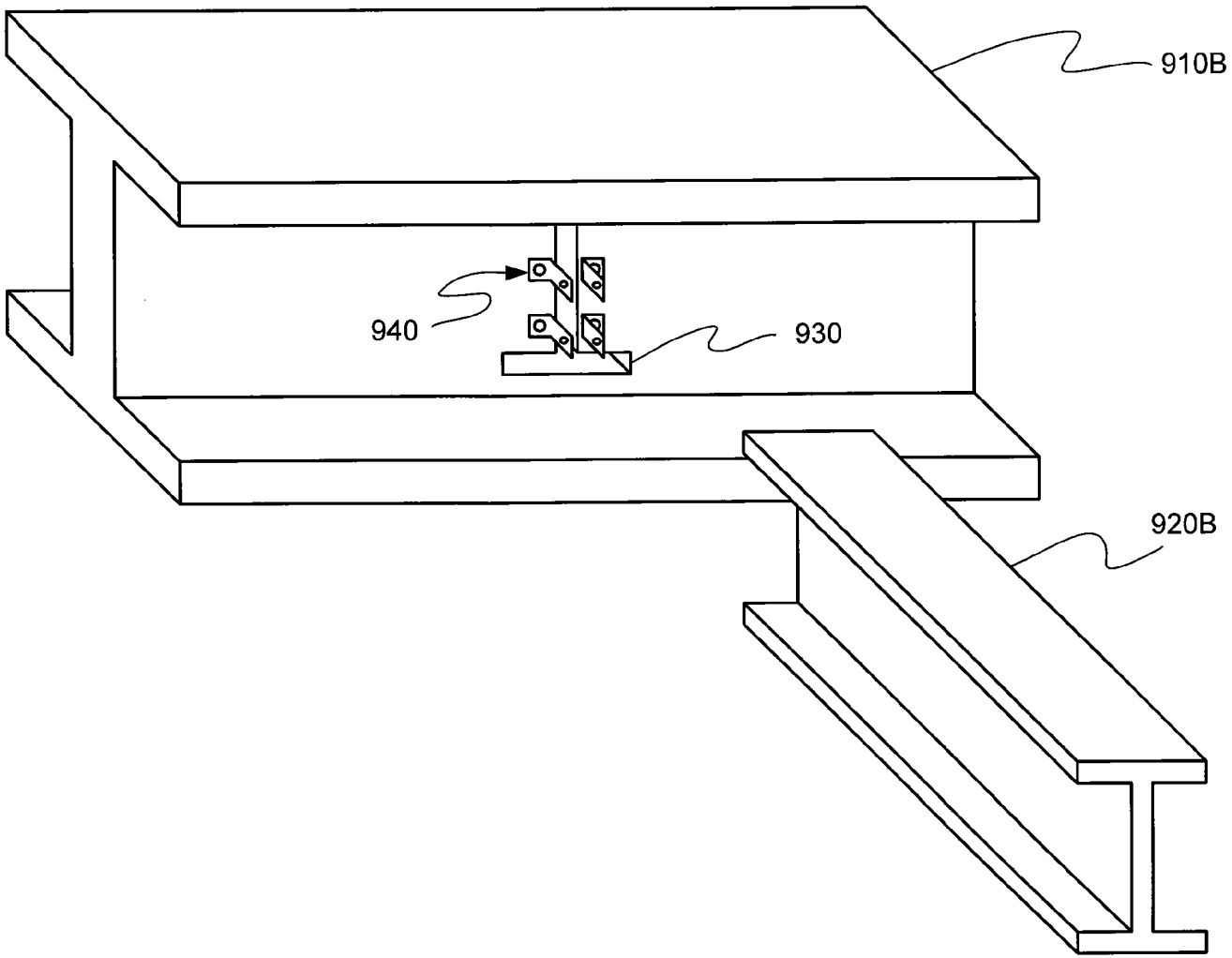
FIG. 9A is an axonometric close-up view of a cavity in one of the longitudinal structural members as well as a latitudinal structural member from FIG. 9.
Figure 9B:
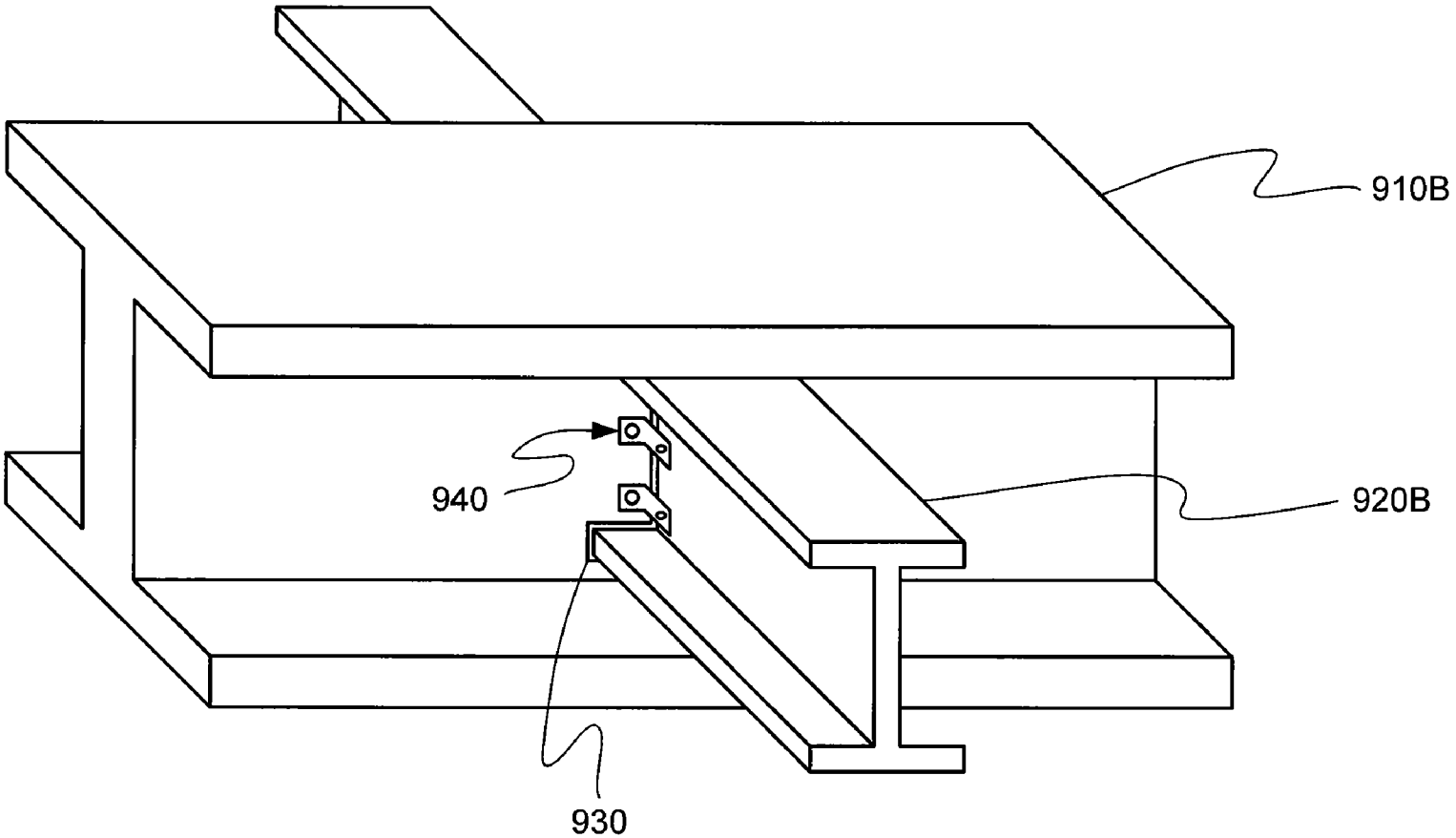
FIG. 9B is an axonometric close-up view of the coupled structural members from FIG. 9A.

FIG. 9A is an axonometric close-up view of a cavity 930 in one of the longitudinal structural members 910B as well as a latitudinal structural member 920B from FIG. 9. FIG. 9B is an axonometric close-up view of the coupled structural members 910A, 920A from FIG. 9A. Connection members 940 may at least assist in coupling longitudinal roof structural member 910B with lateral roof structural member 920B. Cavity 930 may be laser cut to produce as tight a fit as possible between longitudinal roof structural member 910B with lateral roof structural member 920B while still allowing enough clearance for the members to be coupled.

Figure 10:
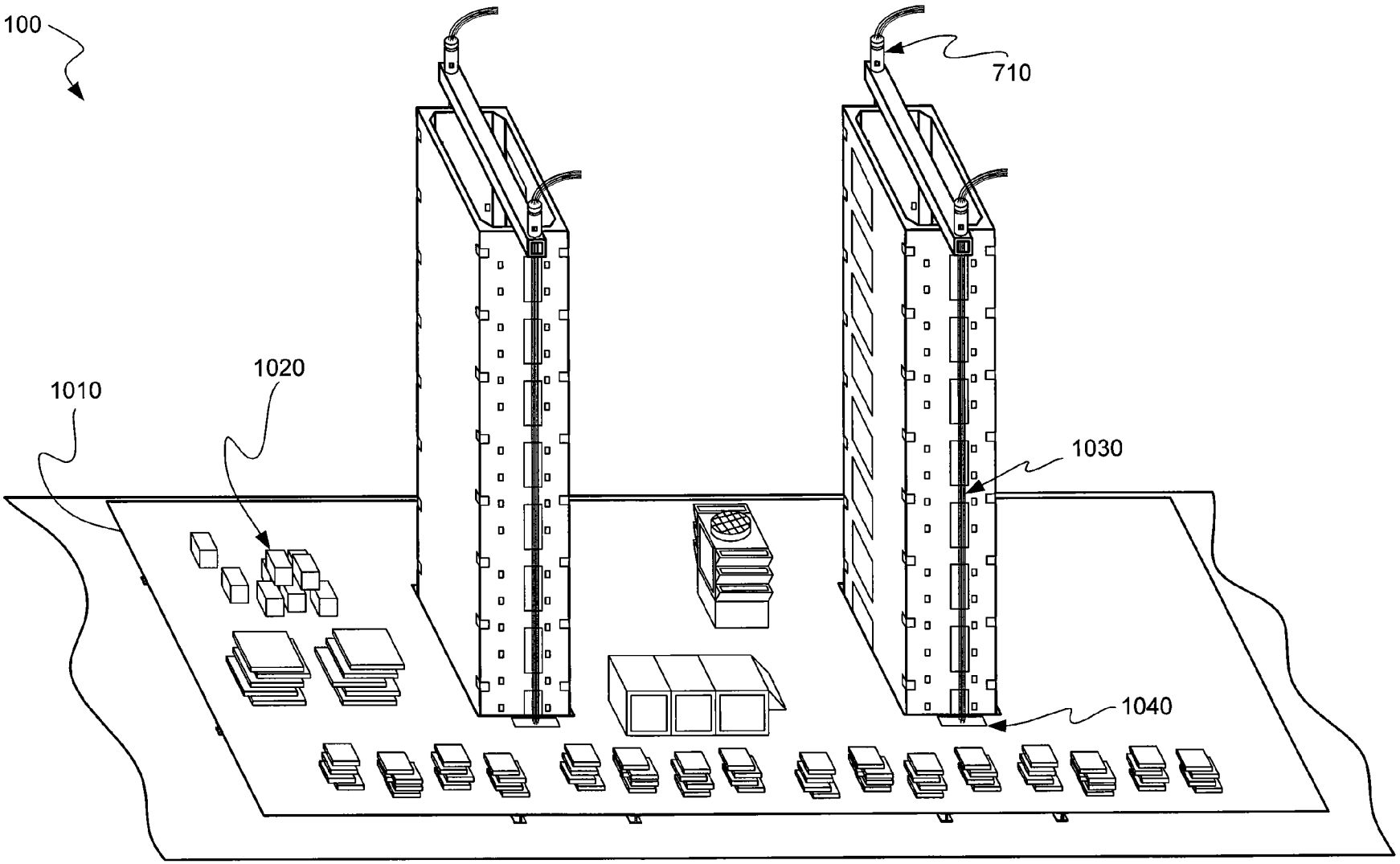
FIG. 10 is an axonometric view of the job site shown in FIG. 9, with complete roof structure, and roof equipment and finishing materials loaded in a preparatory manner.
Figure 11:
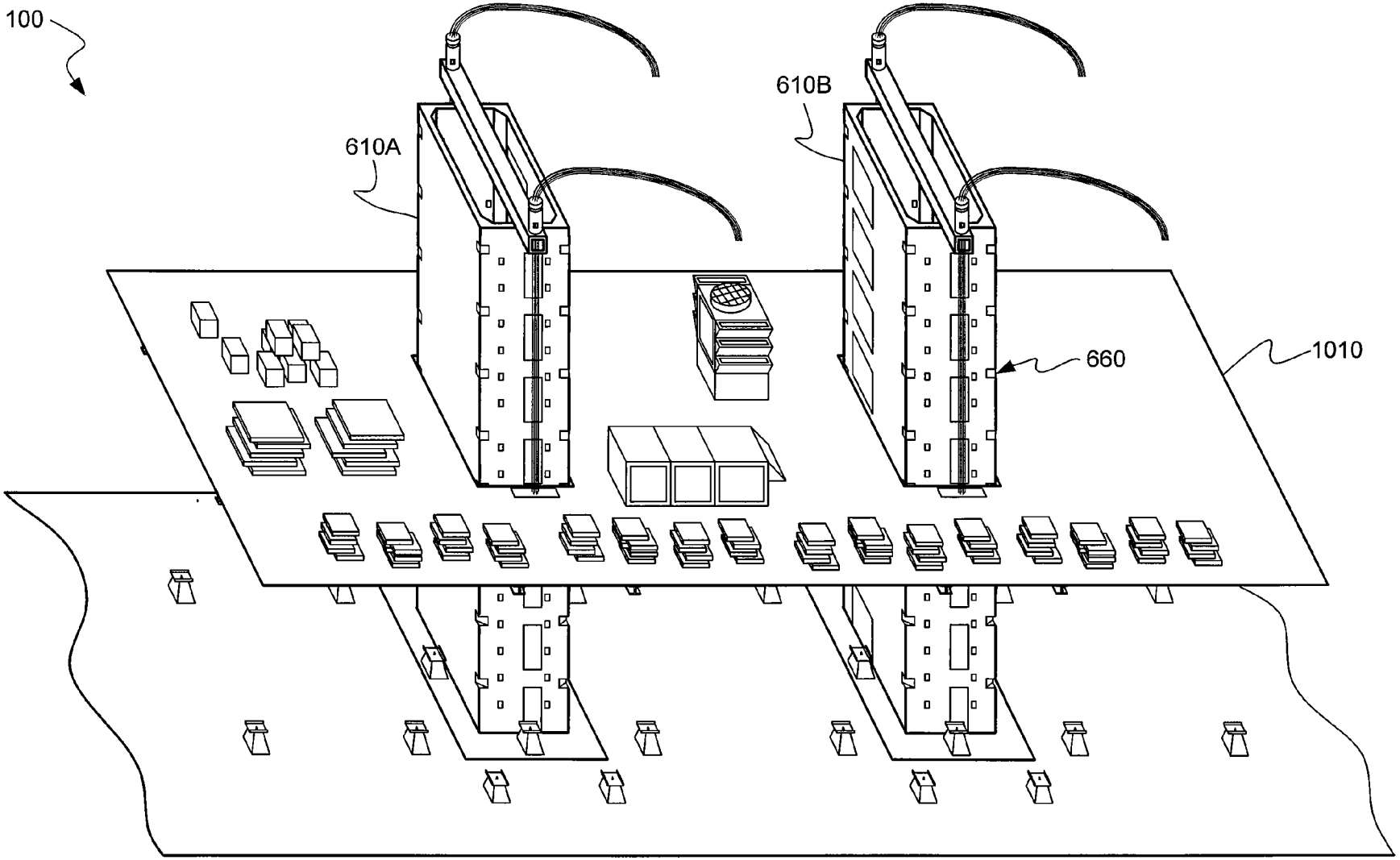
FIG. 11 is an axonometric view of the job site shown in FIG. 10, during lifting of the roof structure.

FIG. 10 is an axonometric view of the job site 100 shown in FIG. 9, with complete roof structure 1010, and roof equipment and finishing materials 1020 loaded in a preparatory manner. Once all roof equipment and finishing materials 1020 are loaded onto the finished roof structure 1010, strands 1030 of strand jacks 710 may be coupled with a possible reinforced section 1040 of roof structure 1010. FIG. 11 is axonometric view of the job site 100 shown in FIG. 10, during lifting of the roof structure 1010. Note that in this embodiment, the temporary filling in each of the support member casings 660 has been removed, possibly by workers on the roof structure 1010 as it is raised up the building cores 610.

Figure 12:
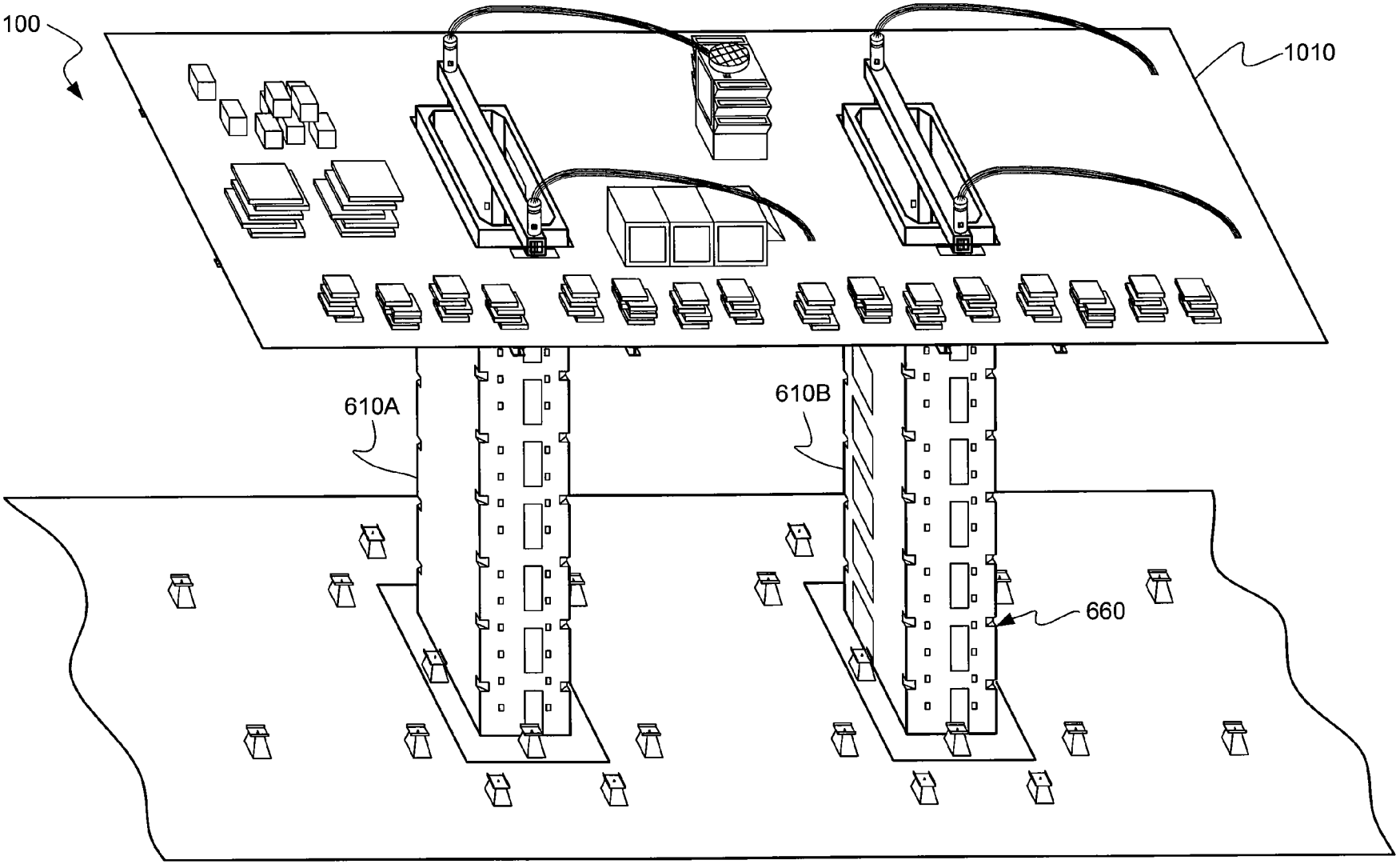
FIG. 12 is an axonometric view of the job site shown in FIG. 11, with the roof structure supported in its final position.
Figure 12A:
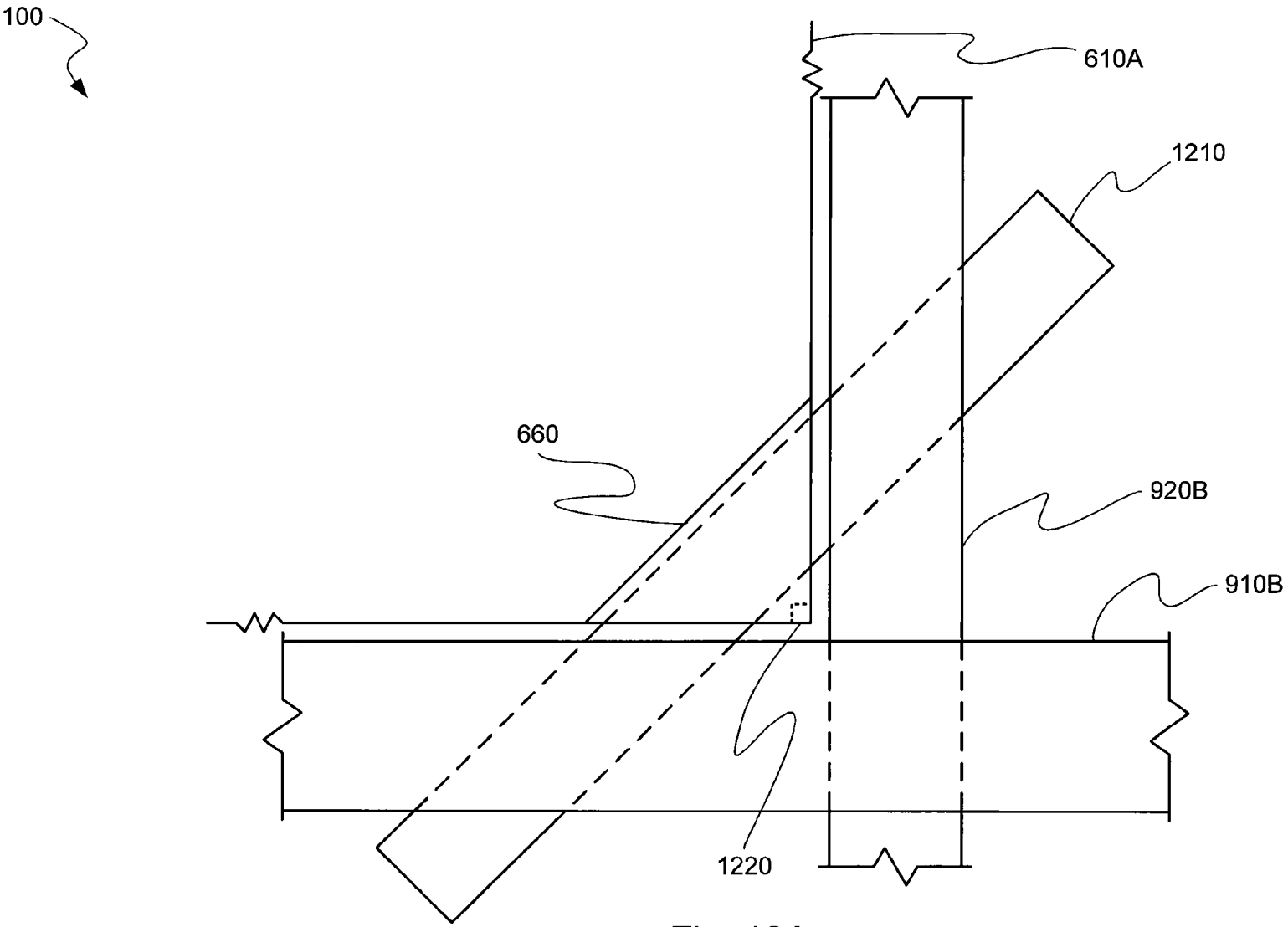
FIG. 12A is a plan close-up view of a support member supporting the roof structure at one corner of one building core from FIG. 12.

FIG. 12 is an axonometric view of the job site 100 shown in FIG. 11, with the roof structure 1010 supported in its final position. Note also that all the temporary fillings have been removed from support member casings 660. Once roof structure 1010 is in its final position, four support members are inserted into each building core's 610 support member casings 660 to support roof structure 1010. FIG. 12A is a plan close-up view of a support member 1210 supporting the roof structure 1010 at one corner of building core 610A from FIG. 12. Note that support member casing 660 may have a structural support 1220 at the corner of the casing 660 to ensure the casing does not collapse prior to, or after insertion of support member 1210.

Figure 12B:
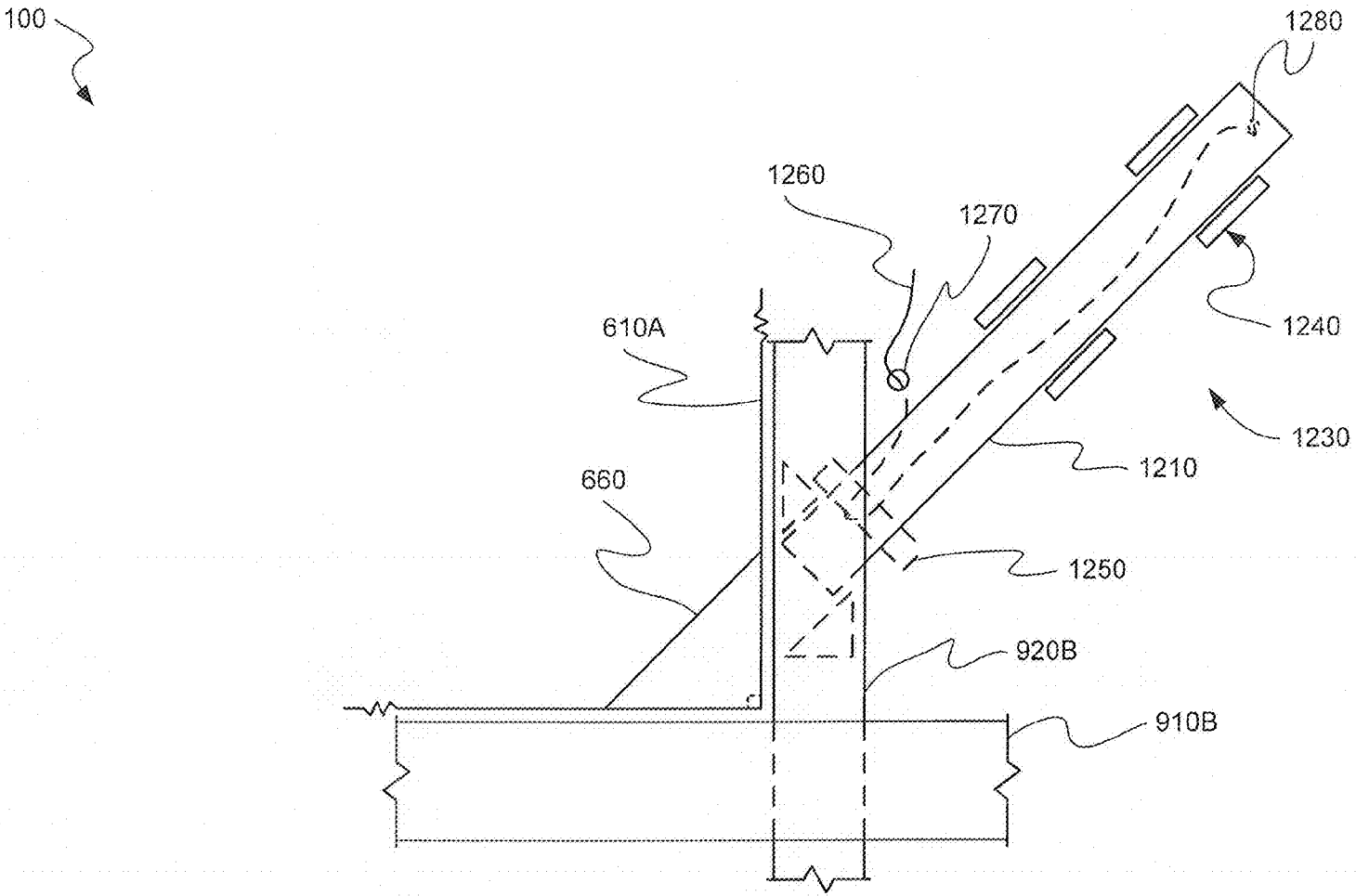
FIG. 12B is a plan close-up view of one possible mechanism for moving a support member into the position shown in FIG. 12A.

FIG. 12B is a plan close-up view of one possible mechanism 1230 for moving a support member 1210 into the position shown in FIG. 12A. Mechanism 1230 consists of guide members 1240, pull axle 1250, and pull chord 1260. Mechanism 1230 may be coupled with the underside of roof structure 1010. A penetration 1270 in roof structure 1010 may allow pull chord 1260 to pass through roof structure 1010 so a worker may operate mechanism 1230.

Once roof structure 1010 is at least approximately in it's final position, a worker on top of roof structure 1010 may pull pull chord 1260. Pull chord 1260 may pull support member 1210 about pull axle 1250 toward and into support member casing 660. Guided by guide members 1240, support member 1210 may therefore be pulled into position from above the roof structure 1010.

Figure 13:
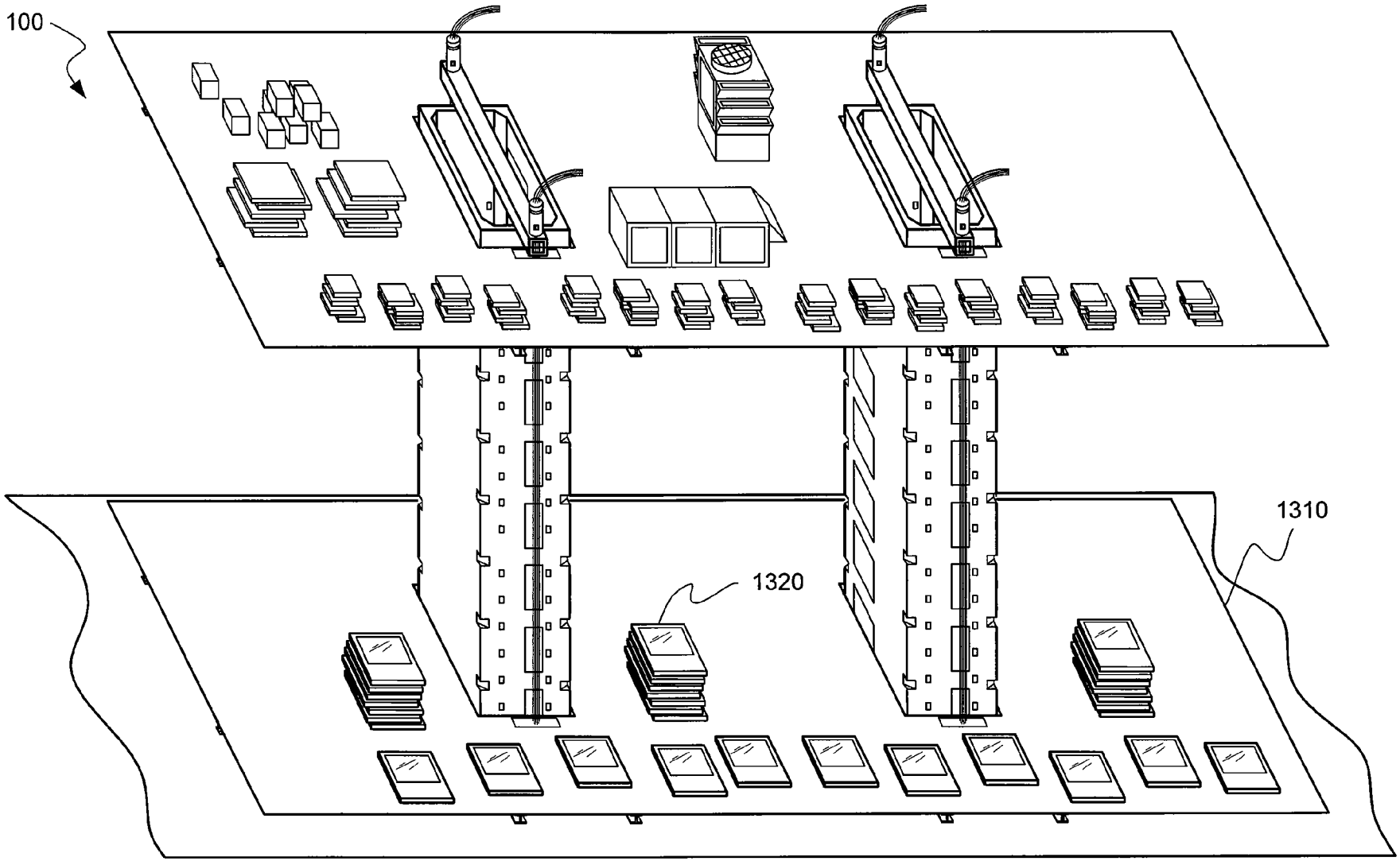
FIG. 13 is an axonometric view of the job site shown in FIG. 12, with a completed top floor structure, and curtain wall materials loaded in a preparatory manner.
Figure 14:
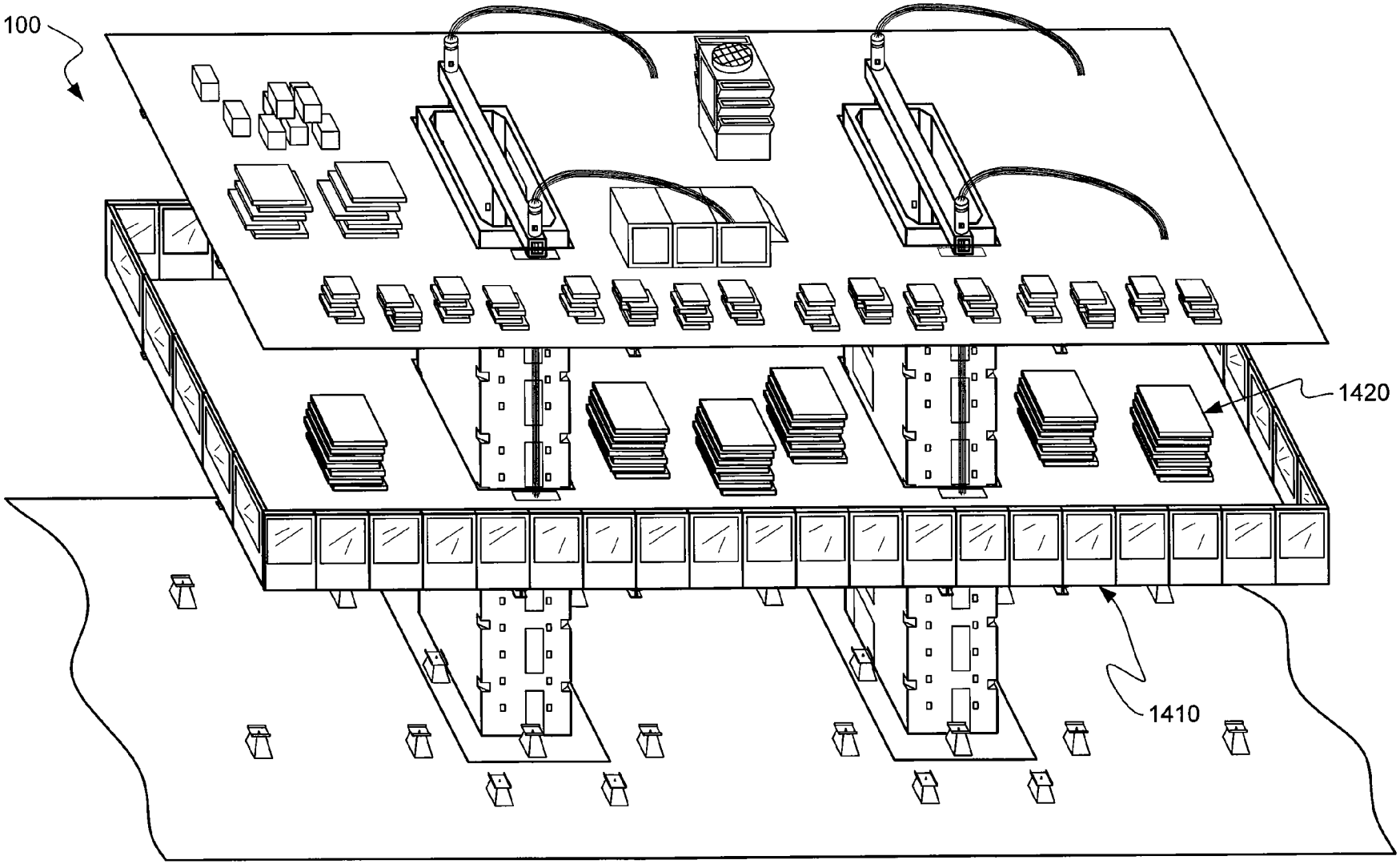
FIG. 14 is an axonometric view of the job site shown in FIG. 13, during lifting of the top floor structure with completed curtain wall.

FIG. 13 is an axonometric view of the job site 100 shown in FIG. 12, with a completed top floor structure 1310, and curtain wall materials 1320 loaded in a preparatory manner. Floor structure 1310 may be constructed similarly to roof structure 1010, possibly as described above. FIG. 14 is an axonometric view of the job site 100 shown in FIG. 13, during lifting of the top floor structure 1310 with completed curtain wall 1410. Note that interior architectural building materials 1420 may be loaded onto floor structure 1310 prior to lifting.

Figure 15:
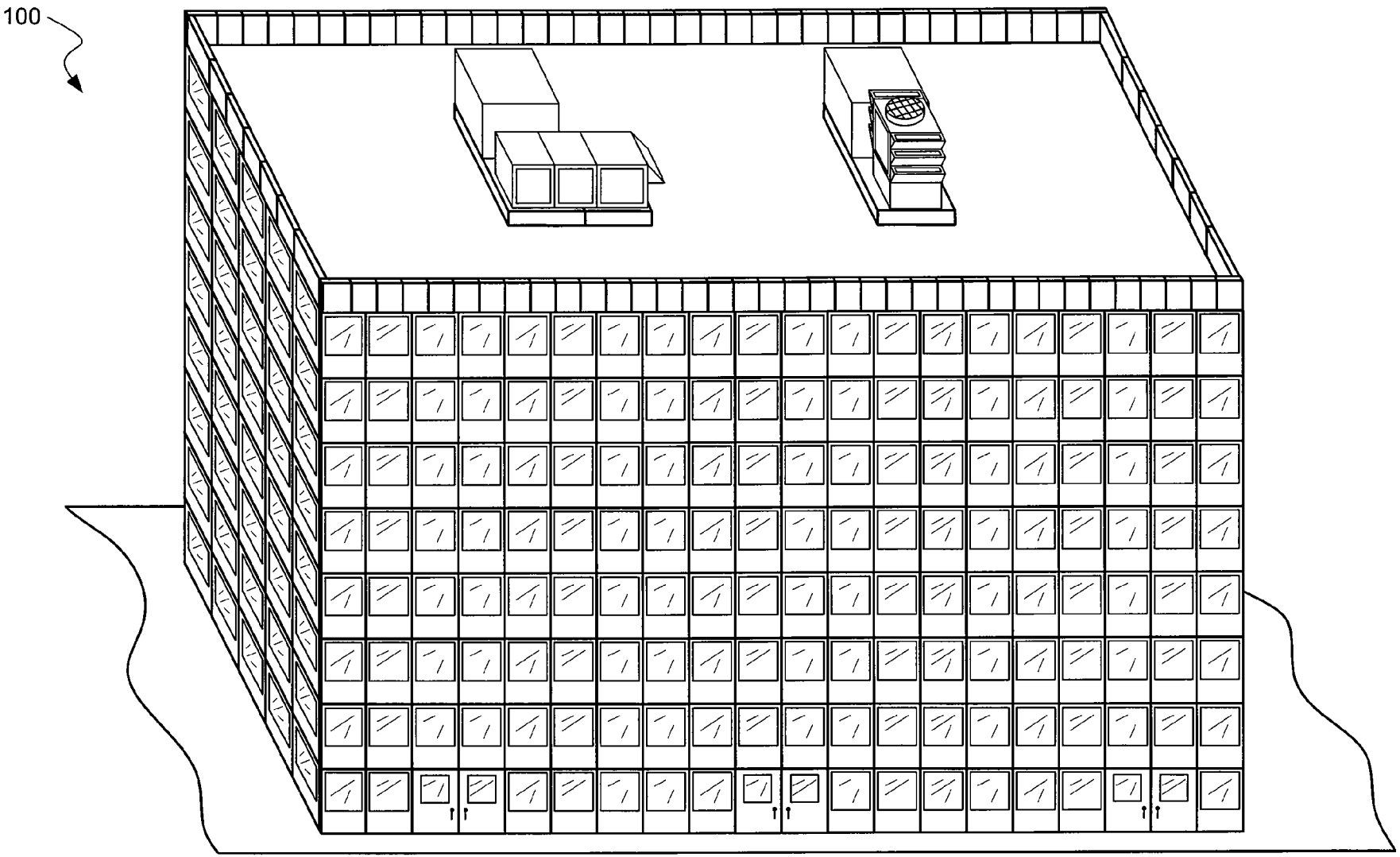
FIG. 15 is an axonometric view of the job site shown in FIG. 14, after completion and lifting of all completed floor structures with completed curtain walls, as well as roof equipment and finishing materials installation.
Figure 16:
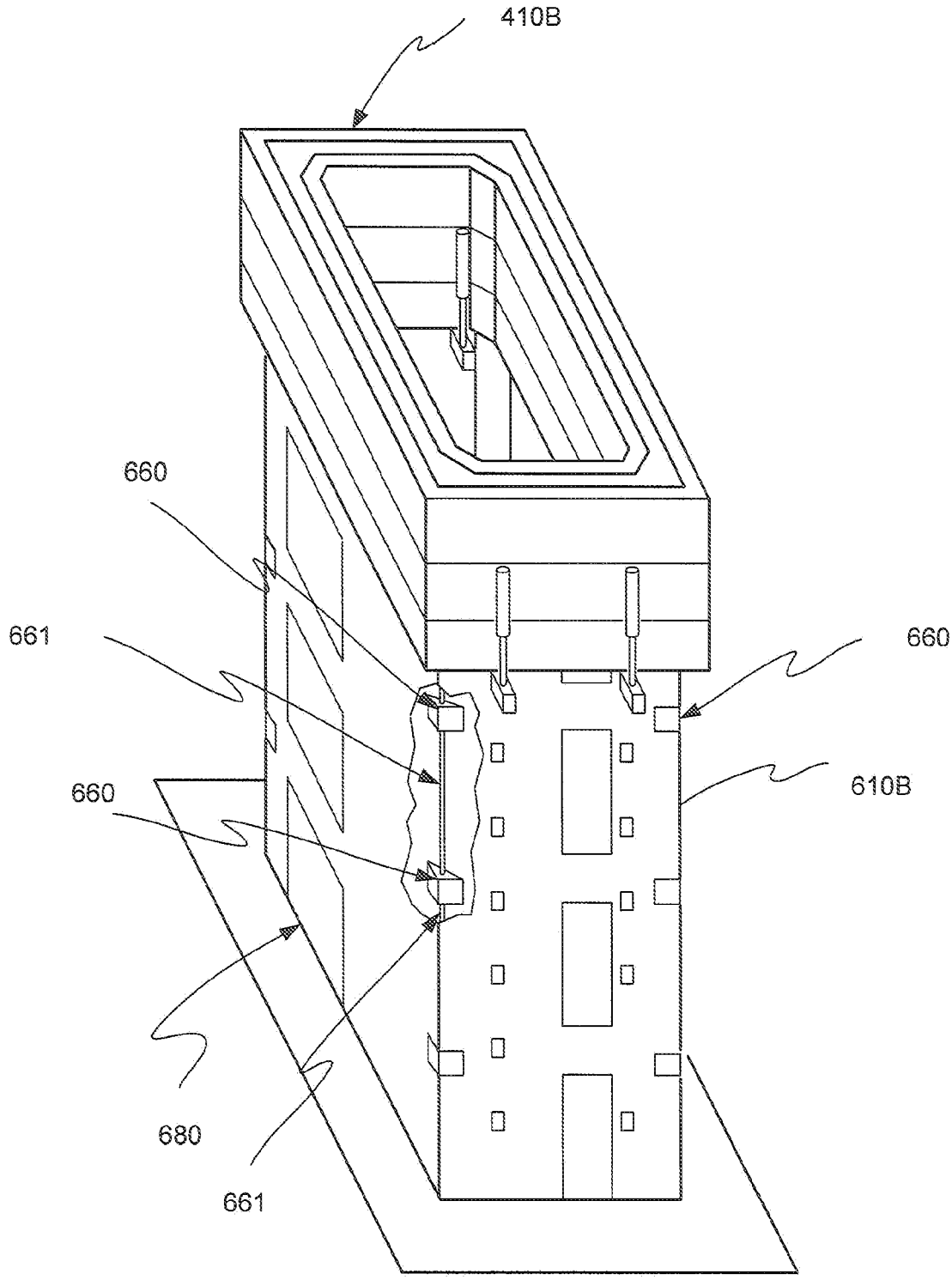
FIG. 16 is an axonometric view of a portion of the job site shown in FIG. 6, with a portion of one of the building cores cut away to reveal vertical members between the support member casings.

The process of creating floors and lifting them to final position is repeated as described above until the building is completed. FIG. 15 is an axonometric view of the job site 100 shown in FIG. 14, after completion and lifting of all completed floor structures with completed curtain walls, as well as roof equipment and finishing materials installation.

The invention has now been described in detail for the purposes of clarity and understanding. However, it will be appreciated that certain changes and to the exemplary embodiments discussed herein may be practiced within the scope of the appended claims.

What is claimed is:

1. A method for constructing a multi-story building, the method comprising:

slip forming, vertically, at least one building core with a hardenable substance, wherein during slip forming, a plurality of support member casings are deposited at least partially within the hardenable substance at a perimeter of the building core, the support member casings being deposited at a plurality of elevations, and wherein each of the support member casings is coupled, via a vertical member prior to being deposited at least partially within the hardenable substance, with another of the support member casings deposited at a different elevation;

providing a plurality of support pedestals around the base of each building core;

supporting a plurality of roof structural members with the support pedestals;

coupling at least one of the plurality of roof structural members with at least one other of the plurality of roof structural members to create a roof structure;

lifting the roof structure to a first elevation from a top of the at least one building core;

supporting a first plurality of support members at least partially with at least two of the plurality of support member casings;

supporting the roof structure at the first elevation with the first plurality of support members;

supporting a plurality of floor structural members with the support pedestals;

coupling at least one of the plurality of floor structural members with at least one other of the plurality of floor support members to create a floor structure;

lifting the floor structure to a second elevation from the top of the at least one building core, wherein the second elevation is lower than the first elevation;

supporting a second plurality of support members at least partially with at least two of the plurality of support member casings; and supporting the floor structure at the second elevation with the second plurality of support members.

2. The method for constructing a multi-story building of claim 1, wherein the method further comprises coupling a plurality of curtain wall components in proximity to an edge of the floor structure to create a curtain wall between the floor structure and the roof structure.

3. The method for constructing a multi-story building of claim 1, wherein the method further comprises coupling a plurality of curtain wall components in proximity to an edge of the floor structure to create a curtain wall beneath an edge of the floor structure.

4. The method for constructing a multi-story building of claim 1, wherein slip forming, vertically, at least one building core with a hardenable substance comprises:

providing a slip form;

coupling a plurality of extendable elements with the slip form and a wall of at least one building core; and extending at least one of the plurality of extendable elements to raise the slip form.

5. The method for constructing a multi-story building of claim 1, wherein:

at least one of the support pedestals comprises a vertical protrusion;

at least one of the roof structural members defines at least one cavity; and wherein supporting a plurality of roof structural members with the support pedestals comprises mating the vertical protrusion at least partially within the cavity.

6. The method for constructing a multi-story building of claim 1, wherein:

the plurality of roof structural members comprises a first roof structural member and a second roof structural member, wherein the first roof structural member defines at least one cavity; and coupling at least one of the plurality of roof structural members with at least one other of the plurality of roof structural members to create a roof structure comprises inserting the second roof structural member into at least one of the cavities.

7. The method for constructing a multi-story building of claim 1, wherein lifting the roof structure to a first elevation from a top of the at least one building core comprises:

coupling a strand jack with the top of the at least one building core;

coupling the strand jack with the roof structure; and activating the strand jack.

8. A method for constructing a multi-story building, the method comprising:

slip forming, vertically, at least one building core with a hardenable substance, wherein during slip forming, a plurality of support member casings are deposited at least partially within the hardenable substance at a perimeter of the slip form;

providing a plurality of support pedestals around the base of each building core;

supporting a plurality of roof structural members with the support pedestals;

coupling at least one of the plurality of roof structural members with at least one other of the plurality of roof structural members to create a roof structure;

lifting the roof structure to a first elevation from a top of the at least one building core;

supporting a first plurality of support members at least partially with at least two of the plurality of support member casings;

supporting the roof structure at the first elevation with the first plurality of support members;

supporting a plurality of floor structural members with the support pedestals;

coupling at least one of the plurality of floor structural members with at least one other of the plurality of floor support members to create a floor structure;

lifting the floor structure to a second elevation from the top of the at least one building core, wherein the second elevation is lower than the first elevation;

supporting a second plurality of support members at least partially with at least two of the plurality of support member casings; and supporting the floor structure at the second elevation with the second plurality of support members;

wherein supporting the first plurality of support members at least partially with at least two of the plurality of support member casings comprises supporting a first support member such that a first end of the first support member protrudes from a first side of the building core, and a second end of the first support member protrudes from a second side of the building core, the second side being adjacent the first side.

9. The method for constructing a multi-story building of claim 1, wherein the first plurality of support members comprises a first support member having a central point, and wherein supporting the roof structure at the first elevation with the first plurality of support members comprises supporting the roof structure on both sides of the central point.

10. A multi-story building constructed by the method in claim 1.

11. A multi-story building, comprising:

at least one building core, wherein:

the at least one building core is vertically slip formed from a hardenable substance;

a plurality of support member casings are deposited at least partially within the hardenable substance at a perimeter of the at least one building core; and each of the support member casings is coupled, via a vertical member, with another support member casing prior to being deposited at least partially within the hardenable substance;

a roof structure, wherein:

the roof structure comprises a plurality of roof structural members;

at least one of the plurality of roof structural members is coupled with at least one other of the plurality of roof structural members;

the roof structure is located at a first elevation after being lifted from a top of at least one building core; and the roof structure is at least partially supported at the first elevation by a first plurality of support members at least partially supported by at least two of the plurality of support member casings; and a floor structure, wherein:

the floor structure comprises a plurality of floor structural members;

at least one of the plurality of floor structural members is coupled with at least one other of the plurality of floor structural members;

the floor structure is located at a second elevation after being lifted from a top of at least one building core, wherein the second elevation is lower than the first elevation; and the floor structure is at least partially supported at the second elevation by a second plurality of support members at least partially supported by at least two of the plurality of support member casings.

12. The multi-story building of claim 11, wherein the multi-story building further comprises a plurality of curtain wall components coupled with the floor structure and the roof structure to create a curtain wall between the floor structure and the roof structure.

13. The multi-story building of claim 11, wherein the multi-story building further comprises a plurality of curtain wall components coupled with the floor structure to create a curtain wall at an edge of the floor structure.

14. The multi-story building of claim 11, wherein the at least one building core being vertically slip formed from a hardenable substance comprises:

providing a slip form;

coupling a plurality of extendable elements with the slip form and a wall of at least one building core; and extending at least one of the plurality of extendable elements to raise the slip form.

15. The multi-story building of claim 11, wherein:

the plurality of roof structural members comprises a first roof structural member and a second roof structural member, wherein the first roof structural member defines at least one cavity; and at least one of the plurality of roof structural members being coupled with at least one other of the plurality of roof structural members comprises the second roof structural member inserted into at least one of the cavities.

16. The multi-story building of claim 11, wherein the roof structure being lifted from the top of at least one building core comprises:

coupling a strand jack with the top of the at least one building core;

coupling the strand jack with the roof structure; and activating the strand jack.

17. A multi-story building, comprising:

at least one building core, wherein:

the at least one building core is vertically slip formed from a hardenable substance; and a plurality of support member casings are deposited at least partially within the hardenable substance at a perimeter of the at least one building core;

a roof structure, wherein:

the roof structure comprises a plurality of roof structural members;

at least one of the plurality of roof structural members is coupled with at least one other of the plurality of roof structural members;

the roof structure is located at a first elevation after being lifted from a top of at least one building core; and the roof structure is at least partially supported at the first elevation by a first plurality of support members at least partially supported by at least two of the plurality of support member casings; and a floor structure, wherein:

the floor structure comprises a plurality of floor structural members;

at least one of the plurality of floor structural members is coupled with at least one other of the plurality of floor structural members;

the floor structure is located at a second elevation after being lifted from a top of at least one building core, wherein the second elevation is lower than the first elevation; and the floor structure is at least partially supported at the second elevation by a second plurality of support members at least partially supported by at least two of the plurality of support member casings;

wherein supporting the first plurality of support members at least partially with at least two of the plurality of support member casings comprises supporting a first support member such that a first end of the first support member protrudes from a first side of the building core, and a second end of the first support member protrudes from a second side of the building core, the second side being adjacent the first side.

18. The multi-story building of claim 11, wherein the at least one building core comprises a first building core, and wherein supporting the first plurality of support members at least partially with at least two of the plurality of support member casings comprises supporting a first support member such that a first end of the first support member protrudes from a first side of the first building core, and a second end of the first support member protrudes from a second side of the second building core.

19. The multi-story building of claim 11, wherein the first plurality of support members comprises a first support member having a central point, and wherein the roof structure is at least partially supported by the first support member on both sides of the central point.

* * * * *